US007585041B2

(12) United States Patent
Kakutani et al.

(10) Patent No.: US 7,585,041 B2
(45) Date of Patent: Sep. 8, 2009

(54) PRINTING WITH LIMITED TYPES OF DOTS

(75) Inventors: Toshiaki Kakutani, Nagano-ken (JP); Takayuki Fukuda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 51 days.

(21) Appl. No.: 11/999,992

(22) Filed: Dec. 7, 2007

(65) Prior Publication Data

US 2008/0094436 A1 Apr. 24, 2008

Related U.S. Application Data

(63) Continuation of application No. 10/934,321, filed on Sep. 2, 2004, now Pat. No. 7,322,664.

(30) Foreign Application Priority Data

Sep. 4, 2003 (JP) ..... 2003-312102
Dec. 8, 2003 (JP) ..... 2003-409000

(51) Int. Cl.
*B41J 2/205* (2006.01)

(52) U.S. Cl. ..... 347/15; 347/43

(58) Field of Classification Search ..... 347/14, 347/15, 40–43, 100
See application file for complete search history.

(56) References Cited

U.S. PATENT DOCUMENTS 4,635,078 A 1/1987 Sakurada et al.
6,257,689 B1 * 7/2001 Yonekubo ..... 347/11
6,328,400 B1 * 12/2001 Yonekubo et al. ..... 347/15

FOREIGN PATENT DOCUMENTS

JP 2000-001001 1/2000
JP 2001-158085 6/2001

OTHER PUBLICATIONS

Abstract of Japanese Patent Publication No. 2000-001001, Pub. Date: Jan. 7, 2000, Patent Abstracts of Japan.
Abstract of Japanese Patent Publication No. 2001-158085, Pub. Date: Jun. 12, 2001, Patent Abstracts of Japan.

* cited by examiner

*Primary Examiner*—Thinh H Nguyen
(74) *Attorney, Agent, or Firm*—Martine Penilla & Gencarella, LLP

(57) ABSTRACT

The present invention provides a printing control method of generating print data to be supplied to a print unit to print. The print unit comprises a print head having a plurality of nozzles and a plurality of ejection drive elements for ejecting an ink from the plurality of nozzles, and is capable of selectively forming one of N types of dots having different sizes at one pixel area with each nozzle. The print control method comprises a dot data generation step of generating dot data representing a state of dot formation at each pixel according to given image data. The dot data generation step includes a step of generating the dot data with a specific dot data generation step for at least a part of the ink types when a printing environment is a specific environment. The specific dot data generation step includes a step of generating the dot data using only a part of dot types among the N types of dots.

3 Claims, 29 Drawing Sheets

Fig.9(a)

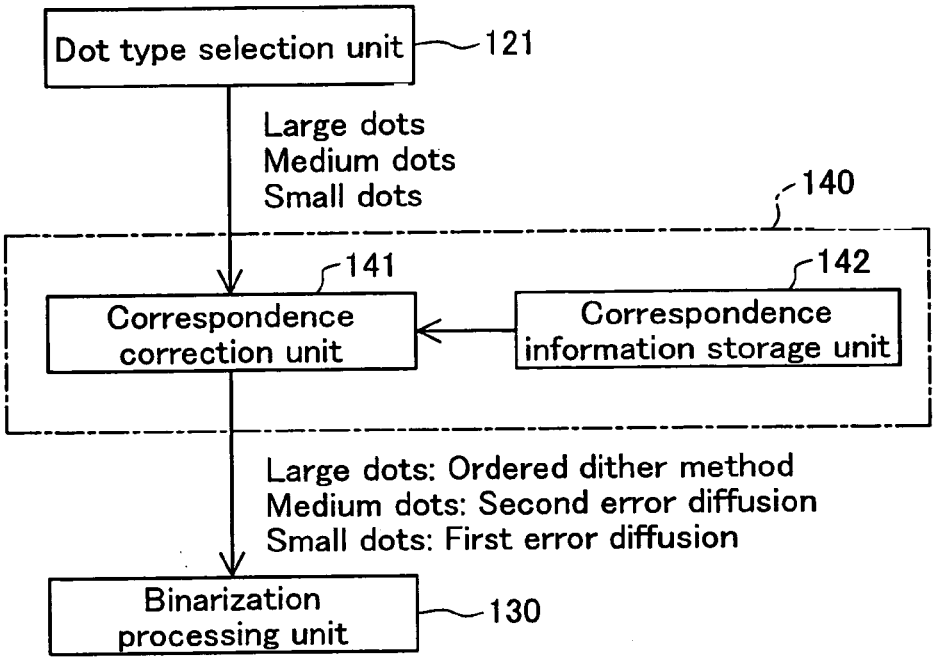

Fig.9(b)

When forming all dots, large, medium, and small

| Dot Size | Large Dots | Medium Dots | Small Dots |
|---|---|---|---|
| Binarization processing method | Ordered dither method | Second error diffusion | First error diffusion |

Fig.9(c)

When forming two types of dots, large and medium

| Dot Size | Large Dots | Medium Dots | Small Dots |
|---|---|---|---|
| Binarization processing method | Second error diffusion | First error diffusion | Not used |

Fig.9(d)

When forming only large dots

| Dot Size | Large Dots | Medium Dots | Small Dots |
|---|---|---|---|
| Binarization processing method | First error diffusion | Not used | Not used |

4 gradation dot recording rate table DT1

3 gradation dot recording rate table DT2

2 gradation dot recording rate table DT3

(b−1)First error diffusion

| | | | | |
|---|---|---|---|---|
| | | * | 7/48 | 5/48 |
| 3/48 | 5/48 | 7/48 | 5/48 | 3/48 |
| 1/48 | 3/48 | 5/48 | 3/48 | 1/48 |

* : Pixel of interest (b−2)Second error diffusion

| | | |
|---|---|---|
| | * | 7/16 |
| 3/16 | 5/16 | 1/16 |

Main scan direction

Sub scan direction

Variation

Fig.19(a)

When forming all dots, large, medium, and small

| Dot Size | Large Dots | Medium Dots | Small Dots |
|---|---|---|---|
| Binarization processing method | Ordered dither method | Second error diffusion | Second error diffusion |

Fig.19(b)

When forming two types of dots, large and medium

| Dot Size | Large Dots | Medium Dots | Small Dots |
|---|---|---|---|
| Binarization processing method | Second error diffusion | Second error diffusion | Not used |

Fig.19(c)

When forming only large dots

| Dot Size | Large Dots | Medium Dots | Small Dots |
|---|---|---|---|
| Binarization processing method | Second error diffusion | Not used | Not used |

Fig.28

Ink Correspondence Table T3

| | Dot Recording Rate Conversion Table |
|---|---|
| C | T1 |
| M | T1 |
| Y | T2 |
| K | T2 |
| Lc | T2 |
| Lm | T2 |

Fig.29

Dot Recording Rate Conversion Table T1

| Ink gradation | Dot recording rate (%) | | |
|---|---|---|---|
| | Large | Medium | Small |
| 0 | 0 | 0 | 0 |
| ⋮ | ⋮ | ⋮ | ⋮ |
| 128 | 24 | 32 | 40 |
| ⋮ | ⋮ | ⋮ | ⋮ |
| 255 | 100 | 0 | 0 |

Table T2

| Ink gradation | Dot recording rate (%) | | |
|---|---|---|---|
| | Large | Medium | Small |
| 0 | 0 | 0 | 0 |
| ⋮ | ⋮ | ⋮ | ⋮ |
| 128 | 35 | 30 | 0 |
| ⋮ | ⋮ | ⋮ | ⋮ |
| 255 | 100 | 0 | 0 |

PRINTING WITH LIMITED TYPES OF DOTS

CROSS REFERENCE TO RELATED APPLICATION

This application is a continuation of U.S. application Ser. No. 10/934,321, filed on Sep. 2, 2004 now U.S. Pat. No. 7,322,664. The disclosure of this prior application from which priority is claimed is incorporated herein by reference.

BACKGROUND OF THE INVENTION

1. Field of the Invention

This invention relates to technology that ejects ink drops and prints an image on a printing medium, and particularly relates to printing technology for which it is possible to record one pixel with a plurality of types of dot sizes.

2. Description of the Related Art

In recent years, as computer output devices, printers that eject ink from the nozzle of a printing head have become widely popular. Among these printers, for example as disclosed in Unexamined Patent No. 2000-1001, multiple value printers have also been realized that are able to form a plurality of types of ink dots of different sizes. With multiple value printers, it is possible to express many gradations with each pixel using a plurality of types of ink dots of different sizes such as small dots and large dots, for example.

However, depending on the printing environment, there are cases when formation of specific ink dots is not desirable. For example, depending on the used ink type, because the ink viscosity is too high, there is the problem that there is too much variation in the dot size or the dots cannot be formed, and this becomes a cause of degradation of image quality.

SUMMARY OF THE INVENTION

The present invention was created to solve the problems of the prior art described above, and its purpose is to provide a technology that, for printing a plurality of types of dots of different sizes, suppresses degradation of image quality due to use of specific types of dots for which use in a specific environment is not desirable.

In order to attain the above and the other objects of the present invention, there is provided a printing control method of generating print data to be supplied to a print unit to print. The print unit comprises a print head having a plurality of nozzles and a plurality of ejection drive elements for ejecting an ink from the plurality of nozzles, and is capable of selectively forming one of N types of dots having different sizes at one pixel area with each nozzle. N is an integer of at least 2. The print control method comprises a dot data generation step of generating dot data representing a state of dot formation at each pixel according to given image data. The dot data generation step includes a step of generating the dot data with a specific dot data generation step for at least a part of the ink types when a printing environment is a specific environment. The specific dot data generation step includes a step of generating the dot data using only a part of dot types among the N types of dots.

With the printing control method of the present invention, when the printing environment is a specific environment, for at least part of the types of ink, the dot data is generated using only part of the types of dots of N types of dots, so it is possible to eliminate formation of specific types of dots for which use with the specific environment is undesirable. By doing this, it is possible to suppress the degradation of image quality due to formation of specific dots.

A printing environment includes the environment of the characteristics of the consumable items such as types of ink and printing media and the characteristics of the printer to which the print control apparatus is connected.

The print control apparatus of the first embodiment of the present invention is a printing control apparatus for generating print data to be supplied to a print unit to print The print unit comprises a print head having a plurality of nozzles and a plurality of ejection drive elements for ejecting an ink from the plurality of nozzles, and is capable of selectively forming one of N types of dots having different sizes at one pixel area with each nozzle. N is an integer of at least 2. The print control apparatus comprises a dot type selector, a processing method determiner, a recording rate determiner, a gradation-reduction processor. The dot type selector selects L type of dot subject to formation by excluding M type of unused dot not subject to formation from the N types of dots according to the printing environment. The processing method determiner determines one of multiple gradation-reduction processing methods used for each of the L types of dots according to each dot type in response to the dot type selection. The multiple gradation-reduction processing methods are provided with different processing contents for the N types of dots. M is an integer of at least 0 and less than N. L is an integer for which M has been subtracted from N. The recording rate determiner determines dot recording rates for each of the L types of dots according to the pixel value of each pixel of the image data, the dot recording rate being a dot-formation ratio of pixels within an uniform area reproduced according to constant pixel values. The gradation-reduction processor determines the formation status of each of the L types of dots for each pixel, according to the determined dot recording rate for each of the L types of dots, with the determined gradation-reduction processing methods. The processing method determiner determines the gradation-reduction processing methods corresponding to each of the L types of dots, by regarding each of the L types of dots as a smaller type of dot in size than the each of the L types of dots by a shift number among the N types of dots, according to the shift number which is a number of the types of unused dots smaller in size than each of the L type dots. The plurality of gradation-reduction processing methods are configured such that the smaller type of dot among the N types of dots a gradation-reduction processing method corresponds to, the higher image quality the corresponding gradation-reduction processing method performs.

In the print control apparatus of the first embodiment of the present invention, the print control apparatus is constructed so that, of the dots which the printing device is able to form, the smaller the relative size of the dot, the higher the image quality that can be realized. With this kind of print control apparatus, when not using one of the types of dots that the printing device is able to form, if made so that dots are regarded as dots the number of sizes smaller as the number of unused dot types for which the size is smaller than each of the dot sizes and the gradation-reduction processing method is determined, it is possible to suppress the degradation of image quality due to part of the dots not being used.

Note that the reason that the smaller the relative dot size is, the better the image quality is because as described above, this improves the dispersibility of small dots, the dot dispersibility of which has a big effect on image quality.

In the print control apparatus of the second embodiment of the present invention, the print control apparatus is constructed so that, of the dots that can be formed by the printing device, the smaller the relative size of the dots, the longer time is required for execution. With this kind of print control apparatus as well, if made so that dots are regarded as a smaller size by the number of types of unused dots and the gradation-reduction processing method is determined, it is possible to suppress the degradation of image quality due to part of the dots being unused.

In the print control apparatus of the third embodiment of the present invention, among the plurality of gradation-reduction processing methods, for the gradation-reduction processing method for which the size of the dots that can be formed are the smallest size dots, the method that is able to realize the highest image quality is used, and for other gradation-reduction processing methods, methods that use a shorter time for execution than this gradation-reduction processing method are used. For this kind of print control apparatus as well, if made so that dots are regarded as a number of sizes smaller as the number of types of unused dots and the gradation-reduction processing method is determined, it is possible to suppress the degradation of image quality due to part of the dots not being used.

In the above printing control apparatus, the processing method determiner may include a function of storing a basic correspondence table indicative of a basic correlation between each of the N types of dots and the gradation-reduction processing methods used for each of the N types of dots and a function of determining a gradation-reduction processing method corresponding to each of the L types of dots based on the basic correspondence table, by regarding each of the L types of dots as a smaller type of dot in size than the each of the L types of dots by a shift number among the N types of dots, according to the shift number which is a number of the types of unused dots smaller in size than each of the L type dots.

In this way, if the number of shifts of each of the selected L types of dots are regarded as small dots and the gradation-reduction process is executed, it is easy to implement the present invention simply by changing the label (data name or flag) of the data that is subject to gradation-reduction processing.

Alternatively, the processing method determiner may include a function of storing a plurality of correspondence tables indicative of a correlation between each of the N types of dots and the gradation-reduction processing methods used for each of the N types of dots and a function of selecting one of the plurality of basic correspondence tables in response to the dot type selection, and also determining a gradation-reduction processing method corresponding to each of the L types of dots based on the selected correspondence table. The plurality of basic correspondence tables are generated by a modification of a basic correspondence table, the modification being made by regarding each of the L types of dots as a smaller type of dot in size than the each of the L types of dots by a shift number among the N types of dots according to the shift number which is a number of the types of unused dots smaller in size than each of the L type dots. The basic correspondence table shows a basic correlation between each of the L types of dots and the gradation-reduction processing method used for each of the L types of dots when M is zero.

In the above printing control apparatus, the gradation-reduction processor may include a function of determining a formation of whether or not for each of the L types of dots on each pixel, according to the determined dot recording rate of each of the L types of dots, with the binarization processing methods selected for each of the L types of dots. Here, "dot formation status" includes cases when dot patterns are formed by a plurality of dots on each pixel such as cases when gradation-reduction processing is performed using a density pattern method, for example.

The print control apparatus of the fourth embodiment of the present invention comprises a dot recording rate conversion means, a half tone processing means, and a printing control means. The dot recording rate conversion means converts ink gradation data into dot recording rate data by referencing a dot recording rate conversion table that prescribes the correlation between the dot recording rate that means the ratio at which dots are formed and the ink gradation value. The ink gradation data shows the volume of ink used for each of a plurality of usable inks expressed by the ink gradation value. The half tone processing means generates dot formation data expressed by whether or not there is dot formation for each dot size by converting the aforementioned dot recording rate data. The printing control means forms dots of each size at the print unit based on the aforementioned dot formation data. The dot recording rate conversion means comprises a plurality of dot recording rate conversion tables including the dot recording rate conversion table expressing dot recording rates for (N-M) types of dots among N formable types of dot. The dot recording rate conversion means refers the different dot recording rate conversion tables in response to type of ink and also generates the dot recording rate data without forming the M types of dots.

In the print control apparatus of the fourth embodiment of the present invention, the dot recording rate conversion means converts ink gradation data, for which the volume of ink used for each of a plurality of usable inks is expressed by the ink gradation value noted above, to dot recording rate data. The aforementioned dot recording rate data has a dot recording rate that means the ratio at which dots are formed on a recording medium for each size of N types of dots that can be formed, and this is generated by referencing a dot recording rate conversion table that prescribes the correlation between the dot recording rate and the ink gradation value. The half tone processing means generates dot formation data expressed by whether or not there is dot formation for each dot size by converting the aforementioned dot recording rate data. Then, by forming dots of each size at the print unit based on the aforementioned dot formation data that was similarly converted by the printing control means, it becomes possible to perform printing on the aforementioned recording medium.

The printing control means forms dots of each size at the print unit based on the aforementioned dot formation data. The dot recording rate conversion means comprises a plurality of dot recording rate conversion tables including the dot recording rate conversion table expressing dot recording rates of (N-M) types of dots among N formable type of dot and also refer the different dot recording rate conversion tables in response to type of ink. The dot recording rate conversion means generates the dot recording rate data without forming the M types of dots.

Specifically, it is possible to make it so that specific sized dots are not formed for specific inks. Therefore, when it is known in advance that a specific size dot of a specific ink cannot be formed suitably, it is possible to prohibit formation of this dot. By doing this, since it is possible to perform printing only of suitable dots, it is possible to improve printing image quality. Here, not being able to suitably form a specific sized dot of a specific ink can be because, for example, the ink ejection amount for forming dots is not stable, or because the dot shape is not suitable. Many of these kinds of problems are caused by reasons specific to inks such as physical properties of the ink, etc., and the size of the dots that cannot be formed is different for each ink. In light of this, with the present invention, by referencing the aforementioned dot recording rate conversion table which is different for each ink, formation of dots of only a specific size of a specific ink for which dot formation is unsuitable is prevented.

In the above printing control apparatus, the plurality of dot recording rate conversion tables are configured such that a coverage rate on a recording medium due to dots formed for the same ink gradation value are mutually equivalent.

With this structure, for the same ink gradation value, no matter which of the plurality of the aforementioned dot recording rate conversion tables is referenced, the coverage of dots formed on the recording medium is equivalent. Specifically, formation of specific sized dots for which dot formation is unsuitable is prevented, and it is also possible to make it so that the coverage on the printing medium does not change in cases when forming the same specific sized dots and in cases when not forming the same specific sized dots.

In the above printing control apparatus, the unused type of dot may include at least one type of dot for which a variation of ejected ink amount is unstable when formed with the specific ink.

With this structure, when the ink ejection amount ejectn for forming specific sized dots for a specific ink is not stable, this is set so that at least there is no formation of that sized dot for that ink. Specifically, the aforementioned dot recording rate conversion table referenced for that ink is expressed as a dot recording rate for dots of (N-M) types of sizes of dots with exclusion of M types of sizes of dots that include that size of dots removed. Therefore, it is possible to prohibit dot formation of a specific sized dot of that ink for which ink ejection amount is not stable. Specifically, it is possible to perform printing only of dots for which the ink ejection amount is stable, and to improve the printing image quality.

In the above printing control apparatus, the unused type of dots may include at least one type of dot for which the dot shape is irregular when formed with the specific ink.

With this structure, when for a specific ink, the shape of a specific sized dot becomes distorted, that sized dot is made not to be formed at least for that ink. Specifically, the aforementioned dot recording rate conversion table that is referenced for that ink is expressed as a dot recording rate for (N-M) type size dots for which M type sized dots that include that sized dot are excluded. Therefore, it becomes possible to prohibit dot formation of specific sized dots for that ink for which the dot shape becomes distorted. Specifically, it is possible to perform printing only for dots for which the dot shape is suitable, and it is possible to improve the printing image quality.

In the above printing control apparatus, the unformed M types of dots with the low density ink may include a small dot in size.

With this structure, for light colored inks, small sized dots are made not to be formed. Specifically, the aforementioned dot recording rate conversion tables referenced for light colored inks are expressed as dot recording rates for (N-M) type sized dots for which M type sized dots that include small sized dots are excluded. Specifically, for the aforementioned light colored inks for which it is difficult to generate a sense of granularity even when the dots are large, it is possible to prohibit formation of small dots. Therefore, it is possible to hold down the frequency of ink ejecting of light colored inks.

Note that the present invention may be realized in various forms such as printing devices, a computer program for realizing the methods of these or the function of the device in a computer, a recording medium on which that computer program is recorded, data signals that are implemented within carrier waves that include that computer program, and computer program products, etc.

BRIEF DESCRIPTION OF DRAWINGS

FIGS. 9 (*a*), 9 (*b*), 9 (*c*), and 9 (*d*) are explanatory diagrams for explaining the state when processing method determining unit 140 determines a binarization processing method used for each sized dot.

FIGS. 19 (*a*), 19 (*b*), and 19 (*c*) are explanatory diagrams that show the method of determining the method of binarization processing used for each sizes dots for a variation of the first embodiment.

FIG. 28 is a chart that shows the ink correspondence table of the second embodiment of the present invention.

FIG. 29 is a chart that shows the dot recording conversion table of the second embodiment of the present invention.

DESCRIPTION OF PREFERRED EMBODIMENTS

Figure 1:
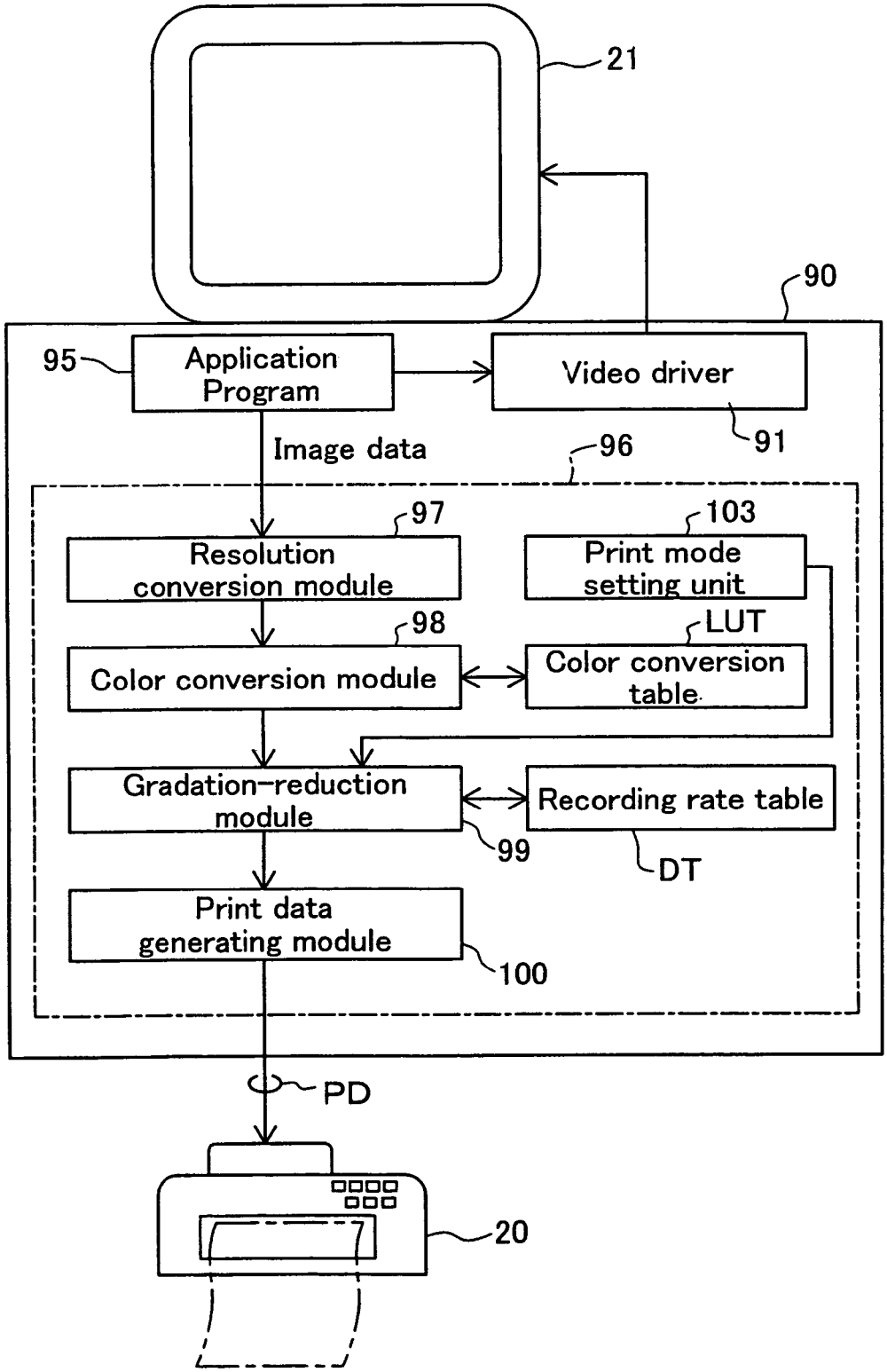
FIG. 1 is a block diagram that shows the structure of a printing system of the first embodiment of the present invention.

A. The Structure of a Printing Apparatus of the First Embodiment of the Present Invention FIG. 1 is a block diagram that shows the structure of a printing system as an embodiment of the present invention. This printing system has a computer 90 as a printing control apparatus, and a color printer 20 as a printing unit. The combination of color printer 20 and computer 90 can be called a "printing apparatus" in its broad definition.

Application program 95 operates on computer 90 under a specific operating system. Video driver 91 and printer driver 96 are incorporated in the operating system, and print data PD to be sent to color printer 20 is output via these drivers from application program 95. Application program 95 performs the desired processing on the image to be processed, and displays the image on CRT 21 with the aid of video driver 91.

In the configuration shown in FIG. 1, printer driver 96 includes resolution conversion module 97, color conversion module 98, gradation-reduction module 99, print data generating module 100, and color conversion table LUT, and Print mode setting unit 103.

Resolution conversion module 97 has the role of converting the resolution (in other words, the pixel count per unit length) of the color image data handled by application program 95 to resolution that can be handled by printer driver 96. Image data that has undergone resolution conversion in this way is still image information made from the three colors RGB. Color conversion module 98 converts RGB image data to multi-tone data of multiple ink colors that can be used by color printer 20 for each pixel while referencing color conversion table LUT.

The color converted multiple gradation data has a gradation value of 256 gradations, for example. The gradation-reduction module 99 executes gradation-reduction processing to express this gradation value at the color printer 20 by dispersing and forming ink dots. The image data that has undergone gradation-reduction processing is realigned in the data order for transferring to the color printer 20 by the print data generating module 100, and is output as final print data PD. Note that the print data PD includes raster data that shows the recording status of the dots during each main scan, and data that shows the sub scan feed volume.

The Print mode setting unit 103 sets the operating mode (printing mode) of the printing device according to the printing environment which is the type of ink used for printing and the printing medium. For example, when using a specific ink for which the viscosity has increased due to higher density, a state described later is assumed whereby small ink dots cannot be ejectn to form small dots for a specific ink. In this kind of case, the printing mode is set to a mode that will perform printing without forming small dots for a specific ink.

Note that the printer driver 96 correlates to a program for realizing the function of generating the print data PD. The program for realizing the function of the printer driver 96 is supplied in a form recorded on a recording medium that can be read by a computer. As this kind of recording medium, it is possible to use various media that can be read by a computer, such as flexible disks, CD-ROM, photo magnetic disks, IC cards, ROM cartridges, punch cards, printed matter on which is printed a code such a bar code, computer internal storage device (memory such as RAM or ROM), and external storage devices, etc.

Figure 2:
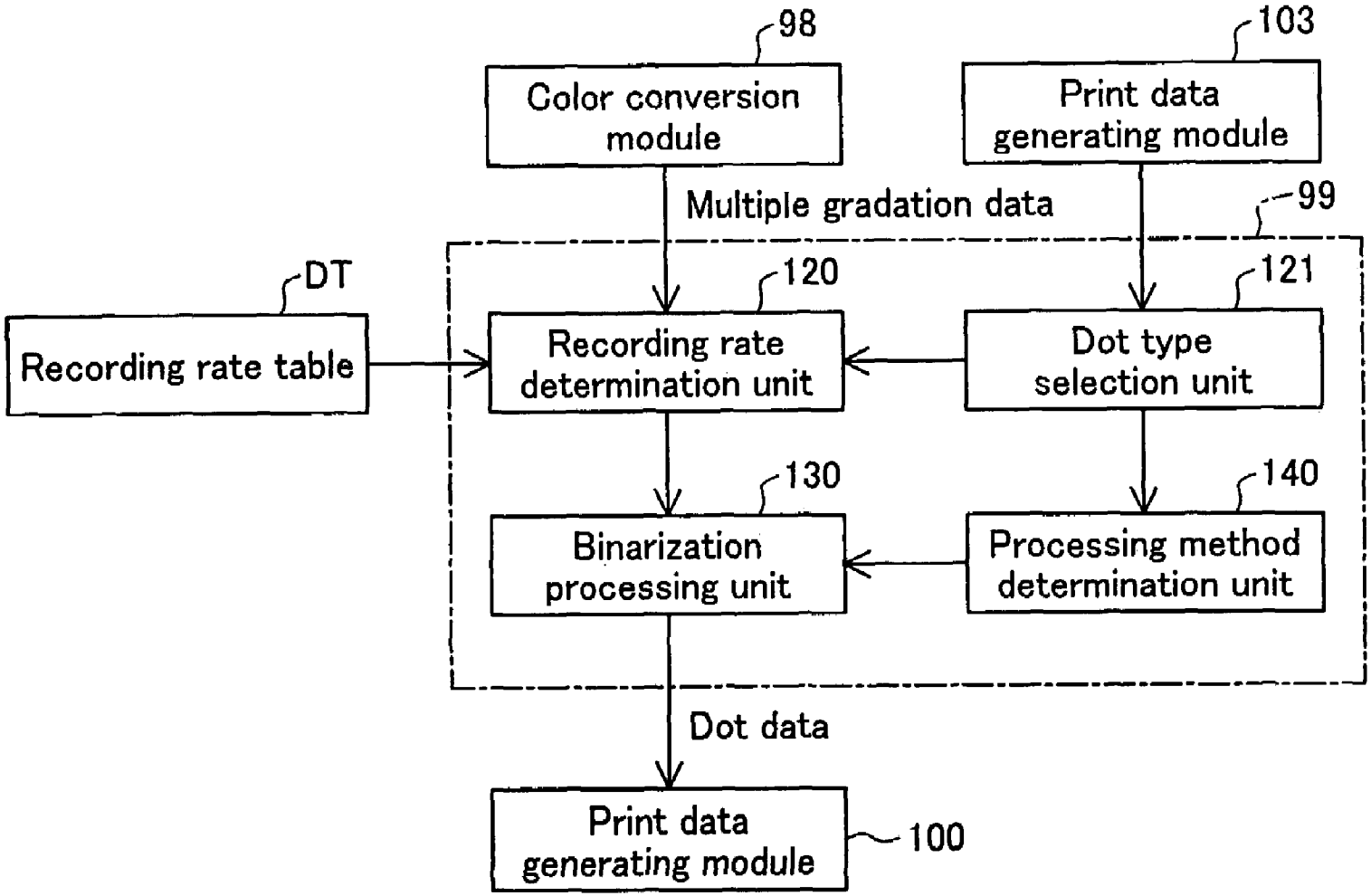
FIG. 2 is a block diagram that shows the structure of a gradation-reduction module 99 of the first embodiment of the present invention.

FIG. 2 is a block diagram that shows the structure of the gradation-reduction module 99 of the first embodiment of the present invention. The gradation-reduction module 99 comprises a dot type selection unit 121 that selects the type of dot used according to the printing mode, a recording rate determination unit 120 that determines the recording rate of each type of dot selected according to the multiple gradation data, a binarization processing unit 130 that sets whether or not to form each size dot of each pixel according to the set recording rate and generates dot data, and a processing method determination unit 140 that determines a method for binarization processing for each size dot. Here, the "dot recording rate" means the ratio of pixels for which dots are formed of the pixels within that area when reproducing a uniform area according to a fixed gradation value. Note that we will give a detailed description about the function of the processing method determination unit 140 later.

Figure 3:
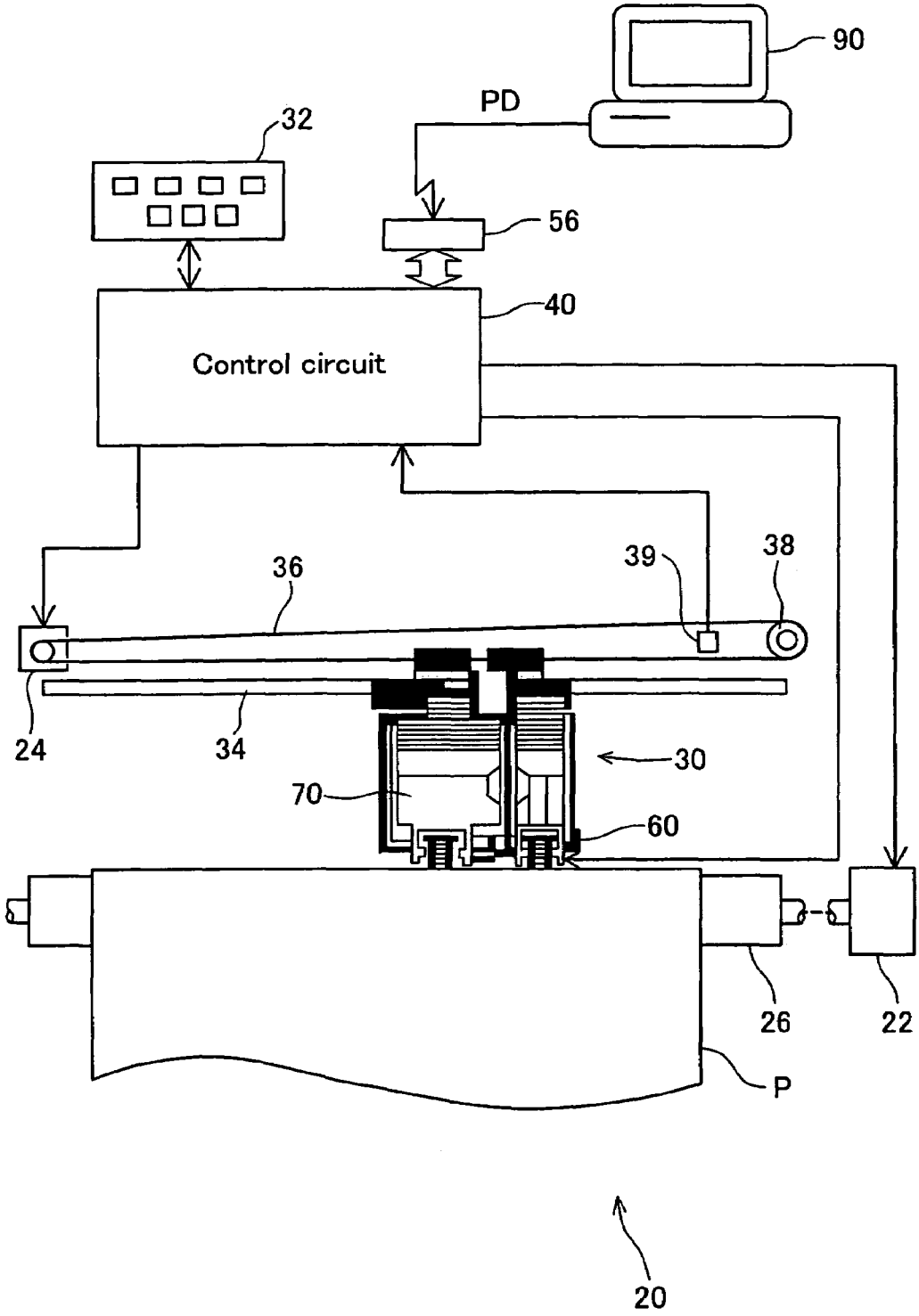
FIG. 3 is a schematic structural diagram of a color printer 20.

FIG. 3 is a schematic structural diagram of the color printer 20. The color printer 20 comprises a sub scan driver unit that carries the printing paper P in the sub scan direction by a paper feed motor 22, a main scan drive unit that moves the carriage 30 back and forth in the axis direction (main scan direction) of a paper feed roller 25 by a carriage motor 24, a head drive mechanism that drives the printing head unit 60 (also called a "printing head assembly") that is incorporated in the carriage 30 and controls ink ejecting and dot formation, and a control circuit 40 that coordinates the exchange of signals between the paper feed motor 22, the carriage motor 24, the printing head unit 60, and the operating panel 32. The control circuit 40 is connected to a computer 90 via a connector 56. The printing head unit 60 is equipped with a printing head 28, and has an ink cartridge 70 mounted.

The sub scan drive unit that carries the printing paper P is equipped with a gear train that is not illustrated that transmits the rotation of the paper feed motor 22 to the paper feed roller 25. Also, the main scan drive unit that makes the carriage 30 go back and forth is equipped with a sliding axis 34 that is built in parallel with the paper feed roller 25 and holds the carriage 30 so as to be able to slide, a pulley 38 that has a seamless drive belt 36 extended between this and the carriage motor 24, and a position sensor 39 that detects the origin point of the carriage 30.

Figure 4:
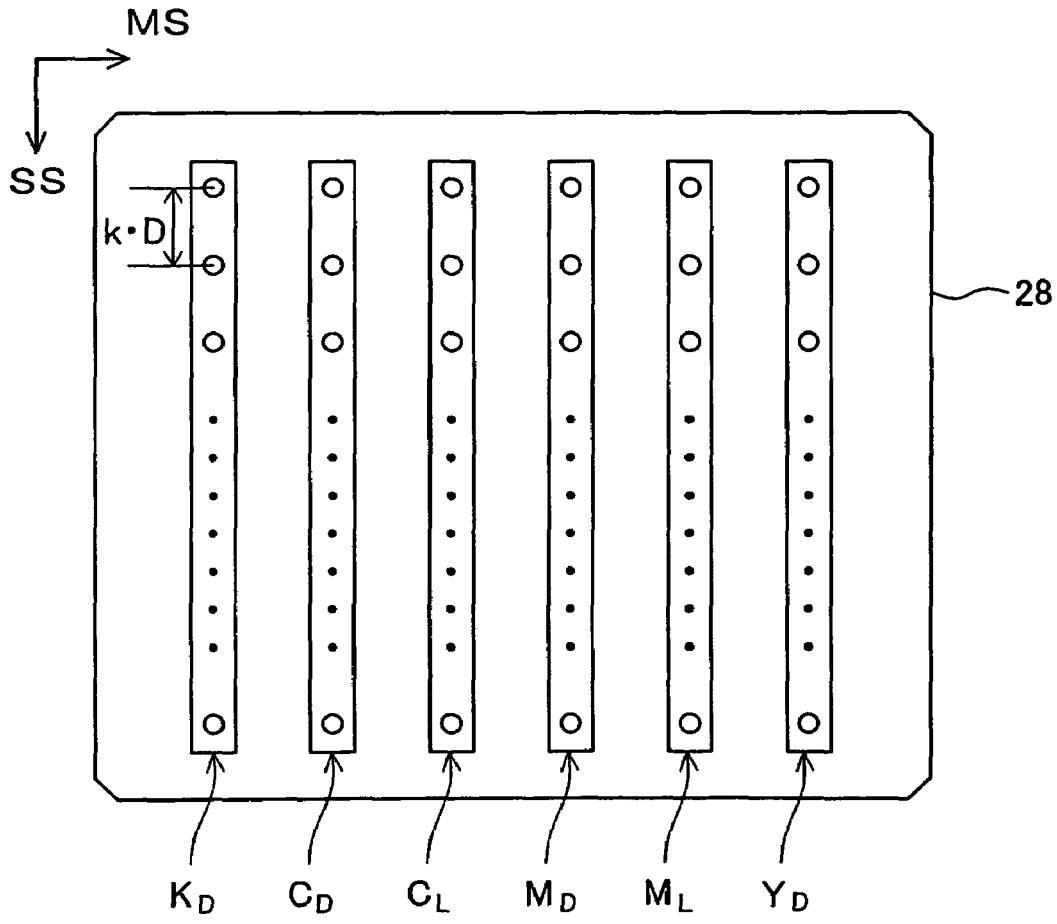
FIG. 4 is an explanatory diagram that shows the nozzle arrangement at the bottom surface of the printing head 28.

FIG. 4 is an explanatory diagram that shows the nozzle array on the bottom surface of printing head 28. Formed on the bottom surface of printing head 28 are black ink nozzle group $K_D$ for ejecting black ink, dark cyan ink nozzle group $C_D$ for ejecting dark cyan ink, light cyan ink nozzle group $C_L$ for ejecting light cyan ink, dark magenta ink nozzle group $M_D$ for ejecting dark magenta ink, light magenta ink nozzle group $M_L$ for ejecting light magenta ink, and yellow ink nozzle group $Y_D$ for ejecting yellow ink.

The upper case alphabet letters at the beginning of the reference symbols indicating each nozzle group means the ink color, and the subscript "D" means that the ink has a relatively high density and the subscript "L" means that the ink has a relatively low density.

Each nozzle is provided with a piezoelectric element (not illustrated) as a drive component that drives each nozzle to ejects ink drops. Ink drops are ejected from each nozzle while printing head 28 is moving in main scan direction MS.

Figure 5:
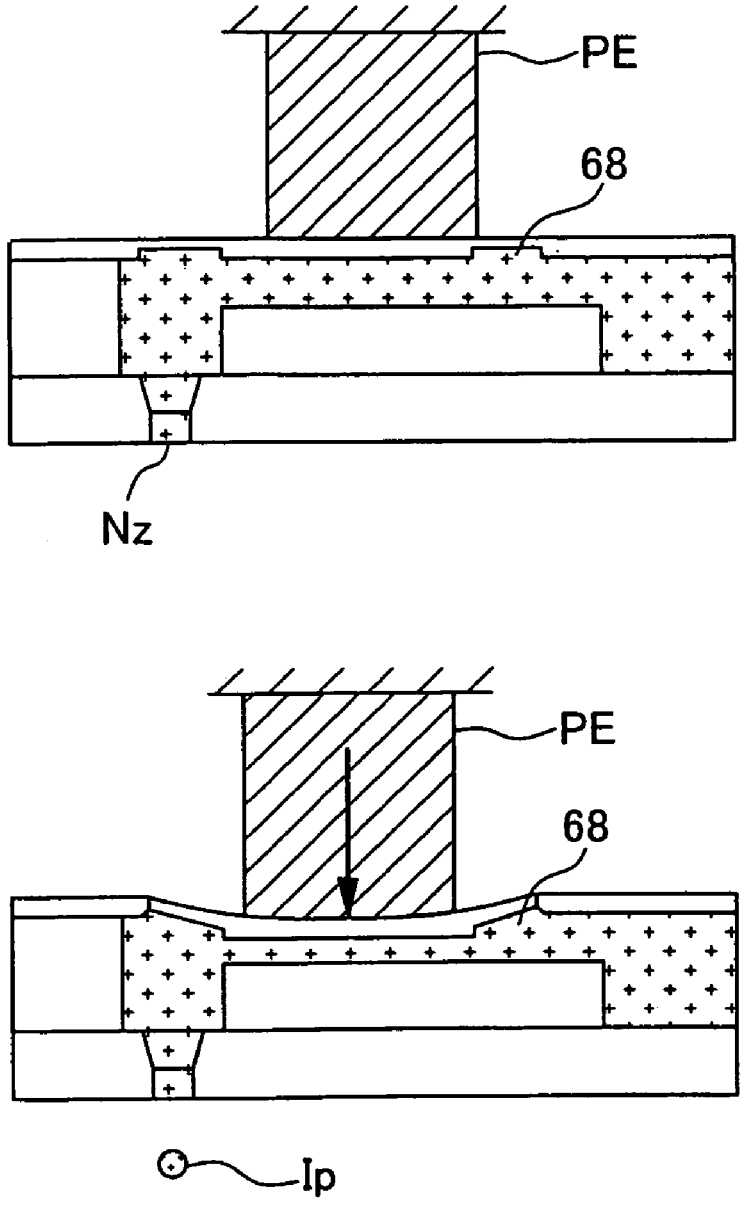
FIG. 5 is an explanatory diagram that shows the structure of the nozzle Nz and the piezo element PE.

FIG. 5 shows the structure of a nozzle Nz and a piezoelectric element PE. The piezoelectric element PE is located at a position in contact with an ink passage 68 that leads the flow of ink to the nozzle Nz. In the structure of the embodiment, a voltage is applied between electrodes provided on both ends of the piezoelectric element PE to deform one side wall of the ink passage 68 and thereby attain high-speed ejection of an ink droplet Ip from the end of the nozzle Nz.

Figure 6A:
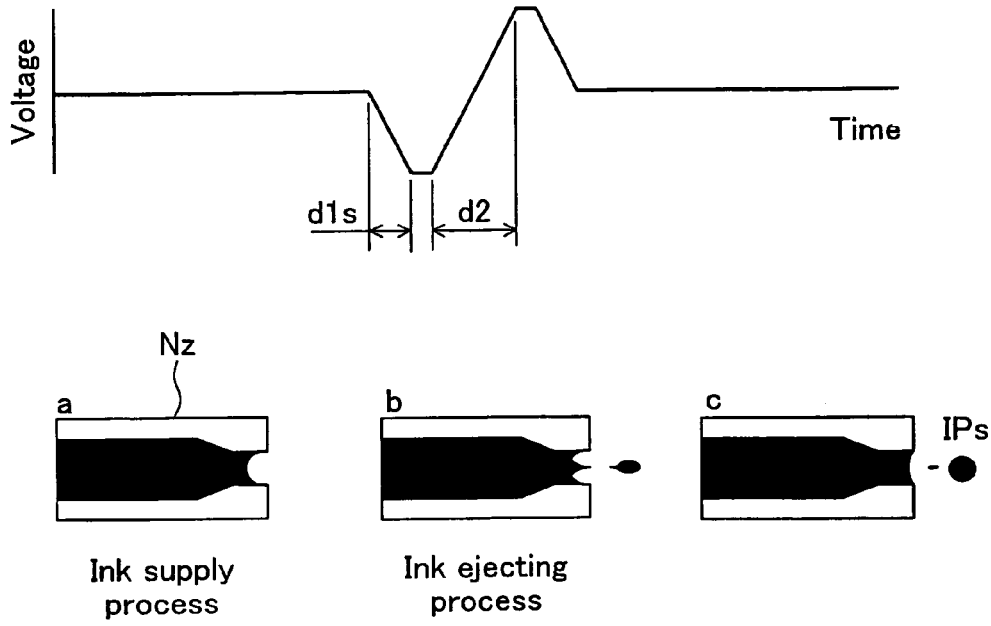
FIGS. 6 (*a*) and 6 (*b*) are explanatory diagrams that show the relationship between the two types of drive waveforms of the nozzle Nz when ink is ejectn and the two sizes of ink drops that are ejectn, IPs and IPm.
Figure 6B:
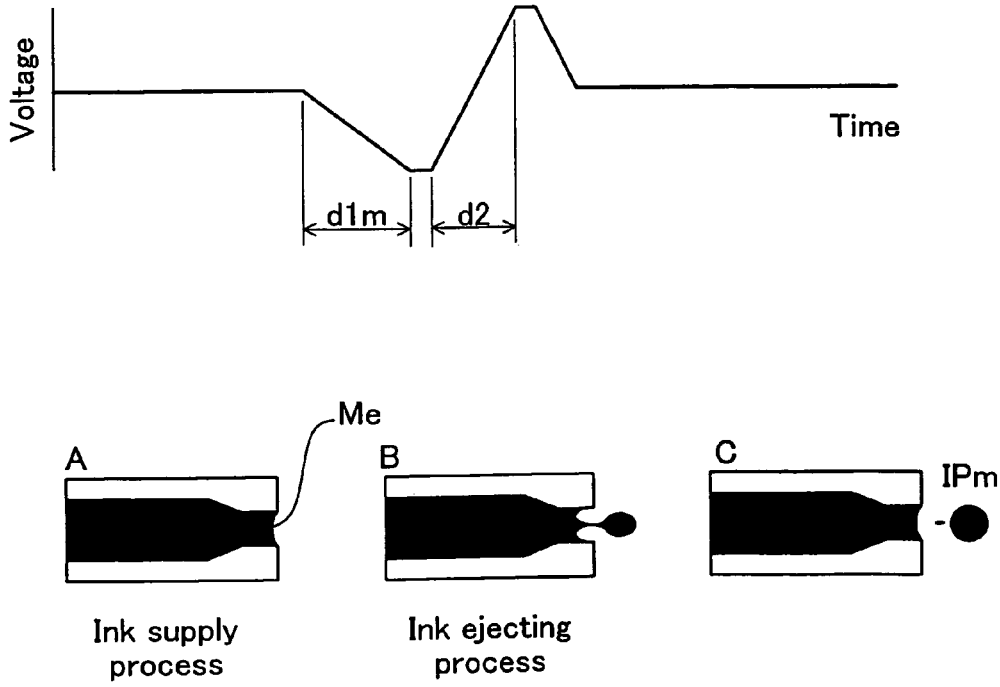

FIGS. 6(*a*) and 6(*b*) show two driving waveforms of the nozzle Nz for ink ejection and resulting small-size and medium-size ink droplets IPs and IPm ejected in response to the driving waveforms. FIG. 6(*a*) shows a driving waveform to eject a small-size ink droplet IPs that independently forms a small-size dot. FIG. 6(*b*) shows a driving waveform to eject a medium-size ink droplet IPm that independently forms a medium-size dot. The small-size dot of this embodiment corresponds to the 'specific dot' in the claims of the invention.

The small-size ink droplet IPs is ejected from the nozzle Nz by two steps given below, that is, an ink supply step and an ink ejection step:

(1) Ink supply step (d1s): The ink passage 68 (see FIG. 5) is expanded at this step to receive a supply of ink from a non-illustrated ink tank. A decrease in potential applied to the piezoelectric element PE contracts the piezoelectric element PE and thereby expands the ink passage 68; and (2) Ink ejection step (d2): The ink passage 68 is compressed to eject ink from the nozzle Nz at this step. An increase in potential applied to the piezoelectric element PE expands the piezoelectric element PE and thereby compresses the ink passage 68.

The medium-size ink droplet IPm is formed by decreasing the potential applied to the piezoelectric element PE at a relatively low speed in the ink supply step as shown in FIG. 6(*b*). A relatively gentle slope of the decrease in potential slowly expands the ink passage 68 and thus enables a greater amount of ink to be fed from the non-illustrated ink tank.

The high decrease rate of the potential causes an ink interface Me to be pressed significantly inward the nozzle Nz, prior to the ink ejection step as shown in FIG. 6(*a*). This reduces the size of the ejected ink droplet. The low decrease rate of the potential, on the other hand, causes the ink interface Me to be pressed only slightly inward the nozzle Nz, prior to the ink ejection step as shown in FIG. 6(*b*). This increases the size of the ejected ink droplet. The procedure of this embodiment varies the size of the ejected ink droplet by varying the rate of change in potential in the ink supply step.

Figure 7:
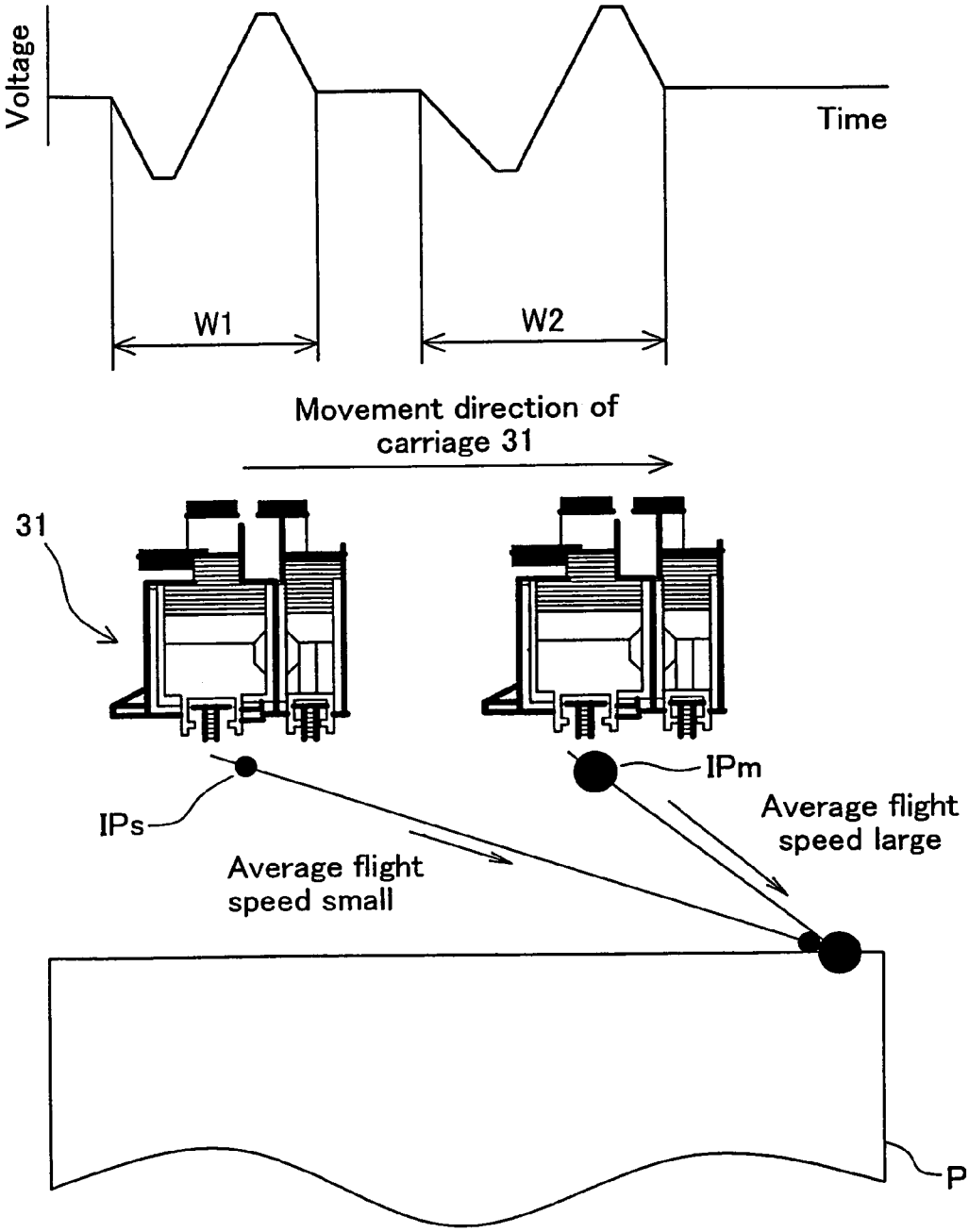
FIG. 7 is an explanatory diagram that shows the state of three sizes of dots large, medium, and small formed at the same position using small ink drops IPs and medium ink drops IPm.

FIG. 7 shows a process of using the small-size and medium-size ink droplets IPs and IPm to form three variable-size dots, that is, large-size, medium-size, and small-size dots, at an identical position. A driving waveform W1 is output to eject the small-size ink droplet IPs, and a driving waveform W2 is output to eject the medium-size ink droplet IPm. As clearly understood from FIG. 7, in the structure of this embodiment, the driving waveform W2 for ejection of the medium-size ink droplet IPm is output after a predetermined time period elapsed since output of the driving waveform W1 for ejection of the small-size ink droplet IPs.

The two driving waveforms W1 and W2 are output to the piezoelectric element PE at these timings, so that the medium-size ink droplet IPm reaches the same hitting position as the hitting position of the small-size ink droplet IPs. As clearly shown in FIG. 7, ejection of the medium-size ink droplet IPm having a relatively high mean flight speed after the predetermined time period elapsed since ejection of the small-size ink droplet IPs having a relatively low mean flight speed enables the two variable-size ink droplets IPs and IPm to reach at substantially the same hitting positions. The mean flight speed represents the average value of flight speed from ejection to hitting against printing paper and decreases with an increase in speed reduction rate.

The ejection speeds of the small-size ink droplet IPs and the medium-size ink droplet IPm are remarkably higher than the moving speed of the carriage 31 in the main scanning direction. The small-size ink droplet IPs is thus not flown alone but is joined with the subsequently ejected medium-size ink droplet IPm to form a large-size ink droplet IPL for formation of a large-size dot. For the purpose of better understanding, the moving speed of the carriage 31 in the main scanning direction is exaggerated in FIG. 7.

The color printer 20 having the hardware configuration described above actuates the piezoelectric elements of the print head 28, simultaneously with a feed of printing paper P by means of the paper feed motor 22 and reciprocating movements of the carriage 30 by means of the carriage motor 24. Ink droplets of respective colors are thus ejected to form large-size, medium-size, and small-size ink dots and form a multi-color, multi-tone image on the printing paper P.

Figure 8:
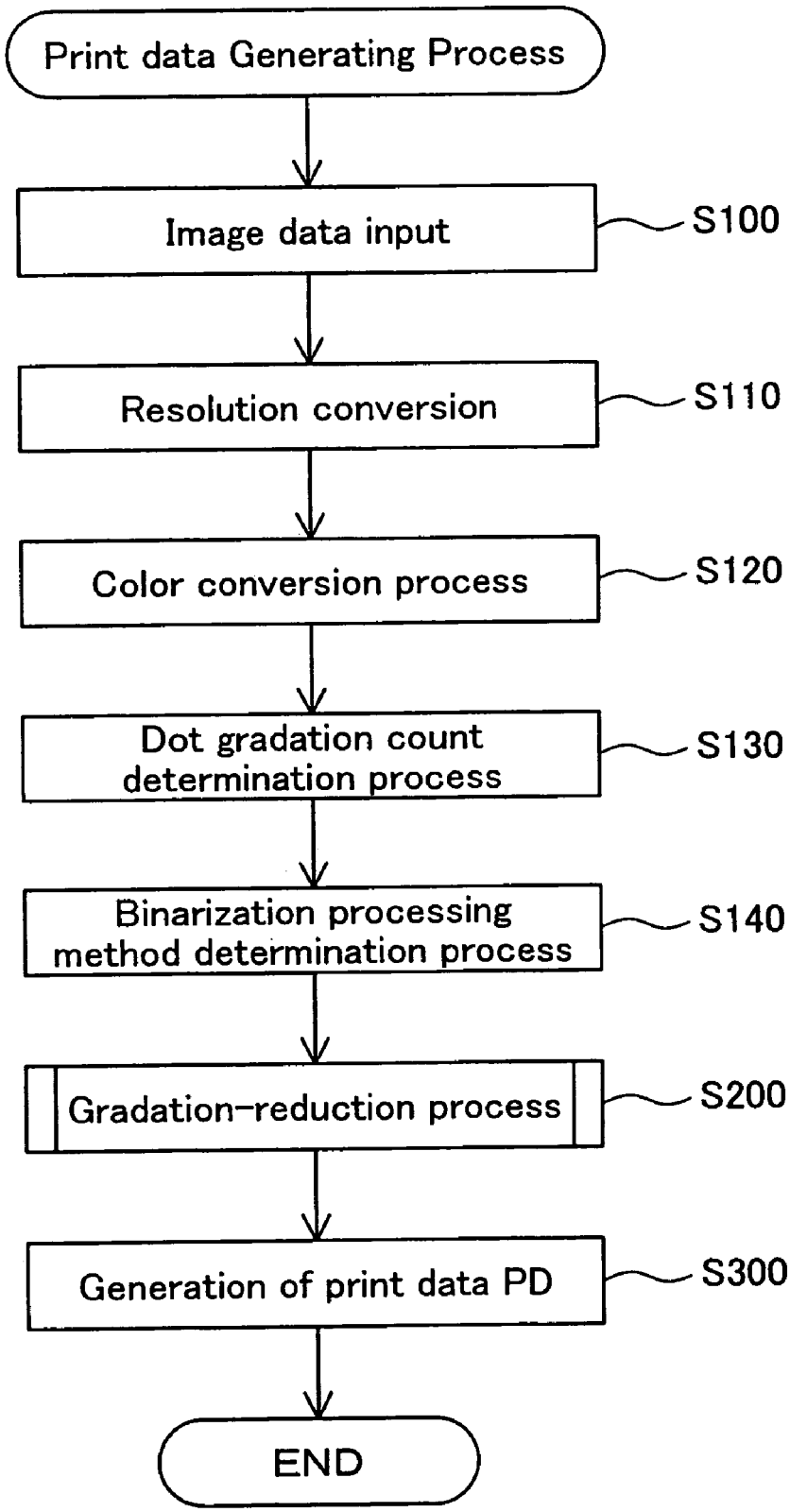
FIG. 8 is a flow chart that shows the print data generating processing routine for the first embodiment of the present invention.

B. Print Data Generating Process for the First Embodiment of the Present Invention FIG. 8 is a flowchart showing a routine of the print data generation process executed in the first embodiment. The print data generation process is executed by the computer 90 to generate print data PD, which is to be supplied to the color printer 20.

At step S100, the printer driver 96 (FIG. 1) inputs image data from the application programs 95. The input of the image data is triggered by a printing instruction given by the application programs 95. Here the image data are RGB data.

At step S110, the resolution conversion module 97 converts the resolution (that is, the number of pixels per unit length) of the input RGB video data into a predetermined resolution.

At step S120, the color conversion module 98, while referencing the color conversion table LUT (FIG. 1), converts the RGB image data for each pixel to multiple gradation data of the ink colors described above that can be used by the color printer 20. With this embodiment, this multiple gradation data undergoes gradation-reduction processing, and is finally expressed as a maximum four gradations of dot data of "no dots formed," "small dots formed," "medium dots formed," and "large dots formed."

At step S130, the dot type selection unit 121 (FIG. 2) that the gradation-reduction module 99 has determines the type of dot used. This determination is performed according to the information that expresses the printing mode input from the Print mode setting unit 103. For example, when a printing mode that does not form small dots is selected, the type of dots that can be formed are only "medium dots formed" and "large dots formed." As a result, the dot gradation count is determined as the three gradations of "no dots formed, "medium dots formed," and "large dots formed."

At step S140, the processing method determination unit 140 selects the binarization processing method for determining whether or not to form dots for each pixel for each type of dot that is able to be formed. This selection is performed based on the correlation between each size dot and the binarization processing method used to determine whether or not that is formed. This correlation is determined in advance for each gradation count.

FIGS. 9 (*a*), 9 (*b*), 9 (*c*), and 9 (*d*) are explanatory diagrams for explaining the status of the processing method determination method unit 140 (FIG. 2) determining the binarization processing method used for each size dot. FIG. 9 (*a*) is an explanatory diagram that shows the structure of the processing method determination unit 140. The processing method determination unit 140 is equipped with a correspondence correction unit 141 and a correspondence information storage unit 142.

With this embodiment, the correspondence information storage unit 142 stores a table on which is recorded the following three types of information.

(1) When the gradation count is four gradations, the binarization processing method used to determine whether or not each size of dots, large, medium, and small, are formed (FIG. 9 (*b*)).

(2) When the gradation count is three gradations, the binarization processing method used to determine whether or not each size of dots, large and medium are formed (FIG. 9 (*c*)).

(3) When the gradation count is two gradations, the binarization processing method used to determine whether or not large dots are formed (FIG. 9 (*d*)).

The correspondence correction unit 141 selects a table according to the dot type selected by the dot type selection unit 121, and also determines the binarization processing method used to determine whether or not each of the selected dot sizes is formed. For example, with the example shown in FIG. 9 (*a*), the dot type selection unit 121 has selected dots of all the sizes, large, medium, and small, so the table for four gradations (FIG. 9 (*b*)) is selected. As a result, the ordered dither method is selected for the binarization process of the large dots, and for the binarization process of the medium dots and small dots, the second error diffusion and first error diffusion are respectively selected.

Each of the binarization processing methods has the following kinds of characteristics. Specifically, ordered dither is a processing method for which processing speed has precedence rather than image quality. Whether or not medium dots and small dots are formed is determined using a second error diffusion and first error diffusion each of which is described later. The second error diffusion is a processing method for which the image quality is better than with ordered dither, and processing speed is faster than with the first error diffusion. The first error diffusion is a processing method which has the highest image quality, but has the slowest processing speed. In this way, with this embodiment, of the plurality of types of dots, the structure is such that the gradation-reduction processing method that corresponds to the smaller dots, the longer the time required for execution.

In this way, whether or not dots are formed is determined using a binarization processing method for which the smaller the dot size, the more that image quality takes precedence over speed, so the probability of being formed individually is higher the smaller the dot size is, and this is because there is a big effect by dot dispersibility on image quality.

Meanwhile, when the dot type selection unit 121 has selected two sizes of dots, large and medium, the three gradation table (FIG. 9 (*c*)) is selected, and the binarization processing method is determined. In specific terms, the second error diffusion is selected for the large dot binarization processing, and the first error diffusion is selected for the medium dot binarization processing.

The three gradation table (FIG. 9 (*c*)) is structured as described below. Specifically, this is a table that is generated based on the table of FIG. 9 (*b*), for which according to the shift number which is the number of unused dot types for which the size is smaller than each of the two types of dots of large and medium for expressing three gradations, each of the two types of dots, large and medium, are regarded as being dots of the number of sizes smaller as the shift number. With this example, small dots are not used, so the number of types of unused dots for which the size is smaller than the large dots is "1." Note that the number of unused dot types for medium dots as well is "1."

By doing this, the large dots are regarded as one size smaller medium dots. Meanwhile, for the medium dots, with the table of FIG. 9 (*a*), the second error diffusion is set, so with FIG. 9 (*b*), the binarization processing method used for large dots is the second error diffusion. Similarly, the binarization processing method used for medium dots is the first error diffusion.

Furthermore, when the dot type selection unit 121 has selected only large dots, the table (FIG. 9 (*d*)) for two gradations is selected and the binarization processing method is also determined. In specific terms, for the large dot binarization process, the first error diffusion is selected.

The table for two gradations (FIG. 9 (*d*)) is structured as described below. Specifically, the shift number, which is the number of unused dot types for which the size is smaller than the large dots for expressing two gradations, is "2," so large dots are regarded as small dots.

In this way, each of the tables in FIG. 9 (*b*) and FIG. 9 (*c*) have the binarization processing method set according to the shift number which is the number of unused dot types for which the size is smaller than each of the dots, and sizes equal to the shift number for each dot are regarded as small dots. This kind of setting is made because when dots of sizes smaller than each of the dots are not used, the number of dots formed together by each dot decreases, and the dot dispersion characteristics have a significant effect on image quality, so this setting suppresses the degradation of image quality due to this.

At step S200, the gradation-reduction module 99 performs gradation-reduction processing. Gradation-reduction processing is a process of reducing the 256 gradations which is the number of gradations of multiple gradation data to a determined gradation count. As shown hereafter, gradation-reduction processing is performed by multiple different methods according to the determined gradation count.

Figure 10:
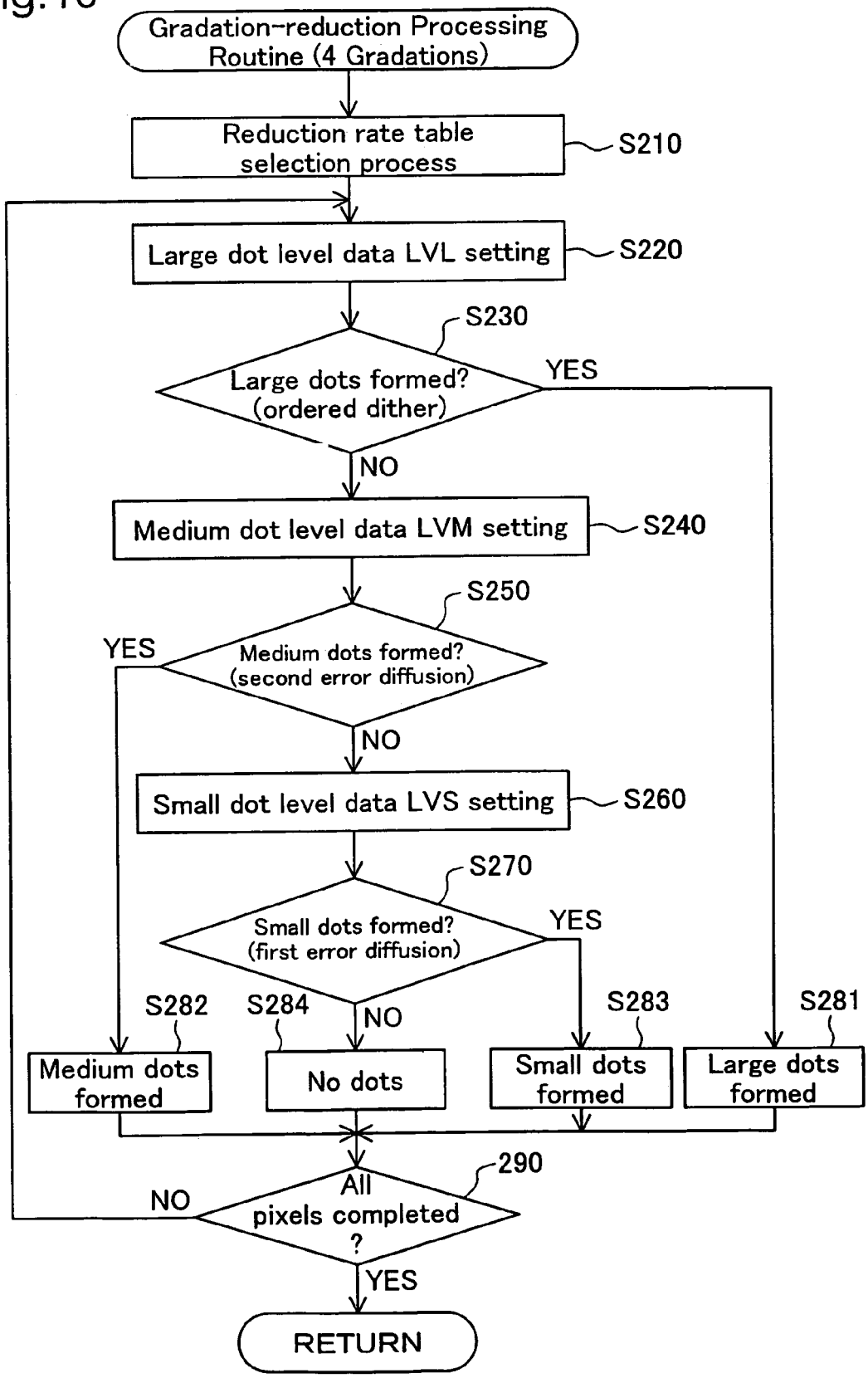
FIG. 10 is a flow chart that shows the flow of gradation-reduction processing in cases when the determined number of gradations is four gradations.

FIG. 10 is a flow chart that shows the flow of gradation-reduction processing when the determined gradation count is four gradations. At step S210, the gradation-reduction module 99 selects the dot recording rate table DT1 for four gradations from among the three types of recording rate tables included in the dot recording rate tables DT.

Figure 11A:
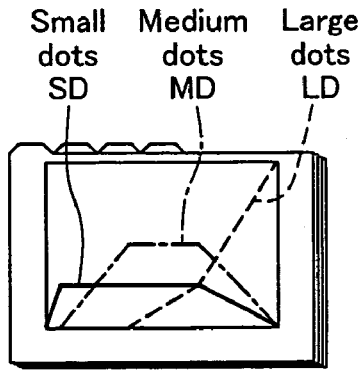
FIGS. 11 (*a*), 11 (*b*), and 11 (*c*) are explanatory diagrams that show three types of dot recording rate tables in cases when the determined number of gradations is four gradations.
Figure 11B:
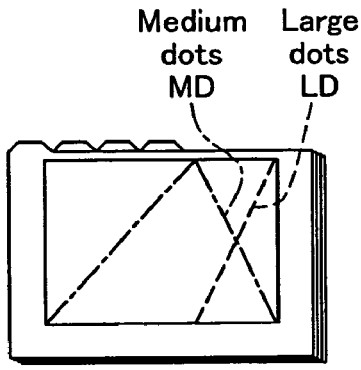
Figure 11C:
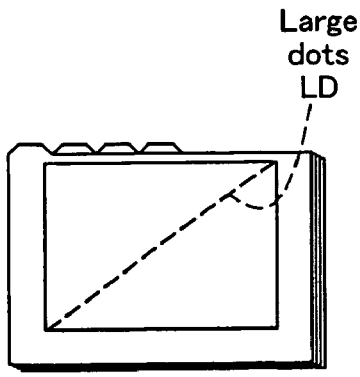

FIGS. 11 (*a*), 11 (*b*), and 11 (*c*) are explanatory diagrams that show three types of dot recording rate tables when the determined gradation count is four gradations. FIG. 11 (*a*) shows the dot recording rate table for four gradations that stores the dot recording rates SD, MD, and LD for each size large, medium, and small. FIG. 11 (*b*) shows a dot recording rate table for three gradations that stores the dot recording rates MD and LD for sizes large and medium. FIG. 11 (*c*) shows a dot recording rate table for two gradations that stores only the recording rate LD for large dots.

At step S220, the gradation-reduction module 99 sets the level data LVL for large dots while referencing the dot recording rate table DT1. Level data means data for which the dot recording rate is converted to 256 gradations with values 0 to 255.

Figure 12:
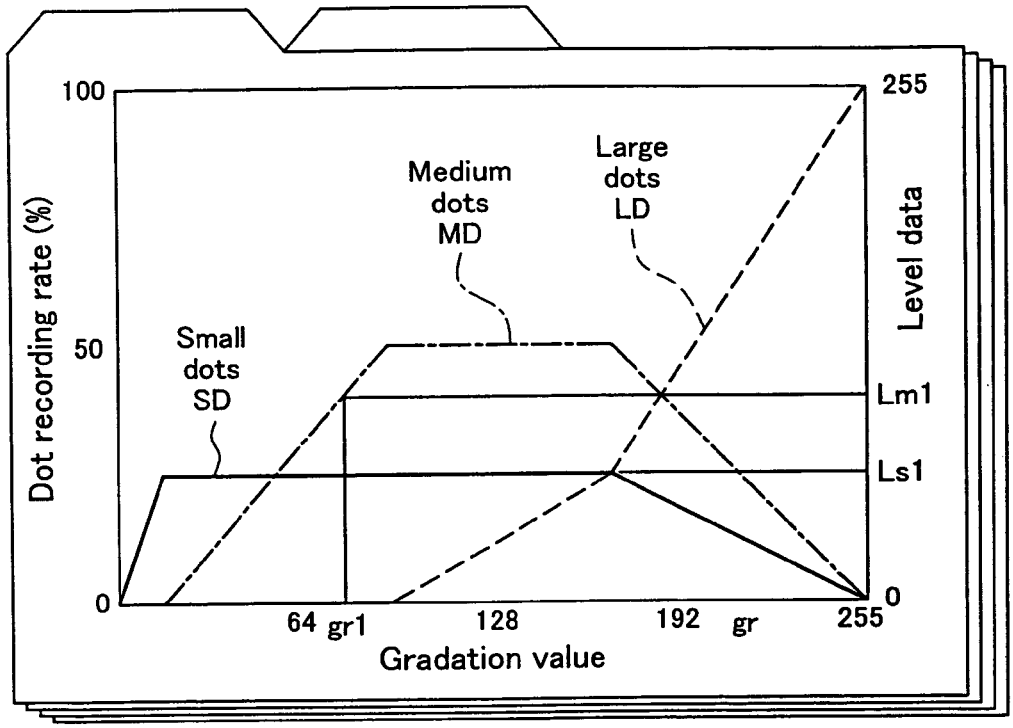
FIG. 12 is an explanatory diagram that shows the dot recording rate table DT3 used to determine the level data of three sizes of dots large, medium, and small.

FIG. 12 is an explanatory diagram that shows the dot recording rate table DT1 used for determining the level data of the three sizes of dots large, medium, and small. The horizontal axis of the dot recording rate table DT1 shows the gradation value (0 to 255), the left side vertical axis shows the dot recording rate (%), and the right side vertical axis shows the level data (0 to 255). The curve SD in FIG. 12 shows the small dot recording rate, the curve MD shows the medium dot recording rate, and the curve LD shows the large dot recording rate.

The level data LVL is data for which the dot recording rate of the large dots was converted, the level data LVM is data for which the dot recording rate of the medium dots was converted, and the level data LVS is data for which the recording rate of the small dots was converted. For example, with the example shown in FIG. 12, if the gradation value of the multiple gradation data is gr1, the large dot level data LVL is obtained as zero using the curve LD, the medium dot level data LVM is obtained as Lm1 using the curve MD, and the small dot level data LVS is obtained as Ls1 using the curve SD.

At step S230, based on the level data LVL set at step S220, it is determined whether or not dots are formed using the ordered dither method selected at step S140 (FIG. 8).

In specific terms, whether or not dots are formed is determined by a size comparison of the level data LVL and the threshold value THL stored in the dither matrix. This threshold value THL has a different value set for each pixel according to the so-called dither matrix. With this embodiment, for a 16×16 square pixel block, a dither matrix for which the values 0 to 254 appear is used.

Figure 13:
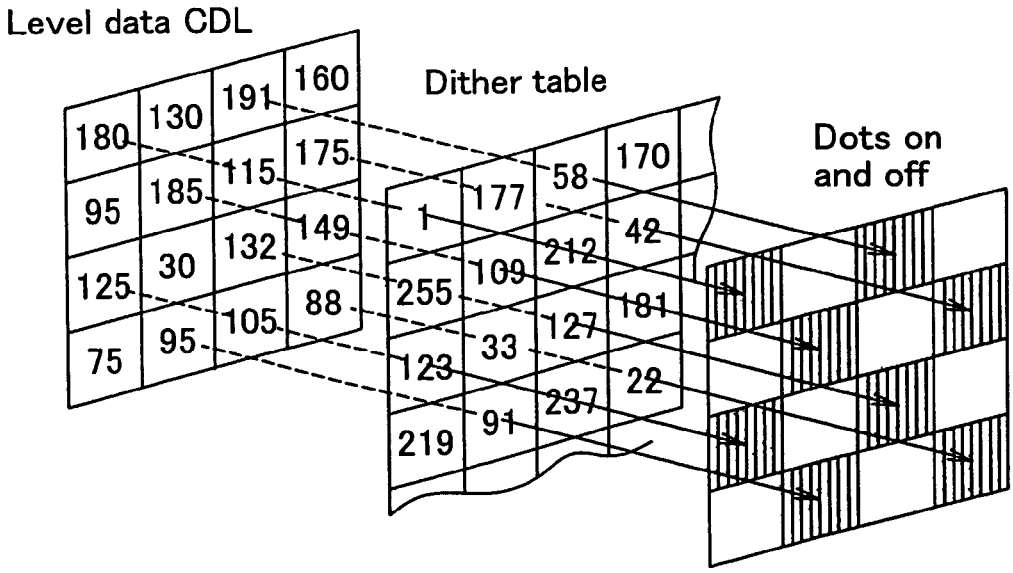
FIG. 13 is an explanatory diagram that shows the idea of the presence or absence of dot formation using the ordered dither method.

FIG. 13 is an explanatory diagram that shows the concept of whether or not dots are formed according to the ordered dither method. Due to illustration circumstances, only part of the pixels are shown. As shown in FIG. 13, a size comparison is done between each pixel of the level data LVL and the corresponding location in the dither table. When the level data LVL is bigger than the threshold value THL shown in the dither table, dots are formed, and when the level data LVL is smaller, dots are not formed. Pixels for which cross hatching is marked in FIG. 13 mean pixels for which dots are formed.

At step S230, when the level data LVL is bigger than the threshold value THL, it is determined that large dots should be formed (step S281). Meanwhile, at step S230, when the level data LVL is smaller than the threshold value THL, it is determined that large dots should not be formed, and the process advances to step S240.

At step S240, the medium dot level data LVM is set. The setting method is the same as the setting of the large dot level data LVL. When the medium dot level data LVM is set, whether or not dots are formed is determined by the second error diffusion process (step S250) selected at step S140 (FIG. 8).

Figures 14A, 14B:
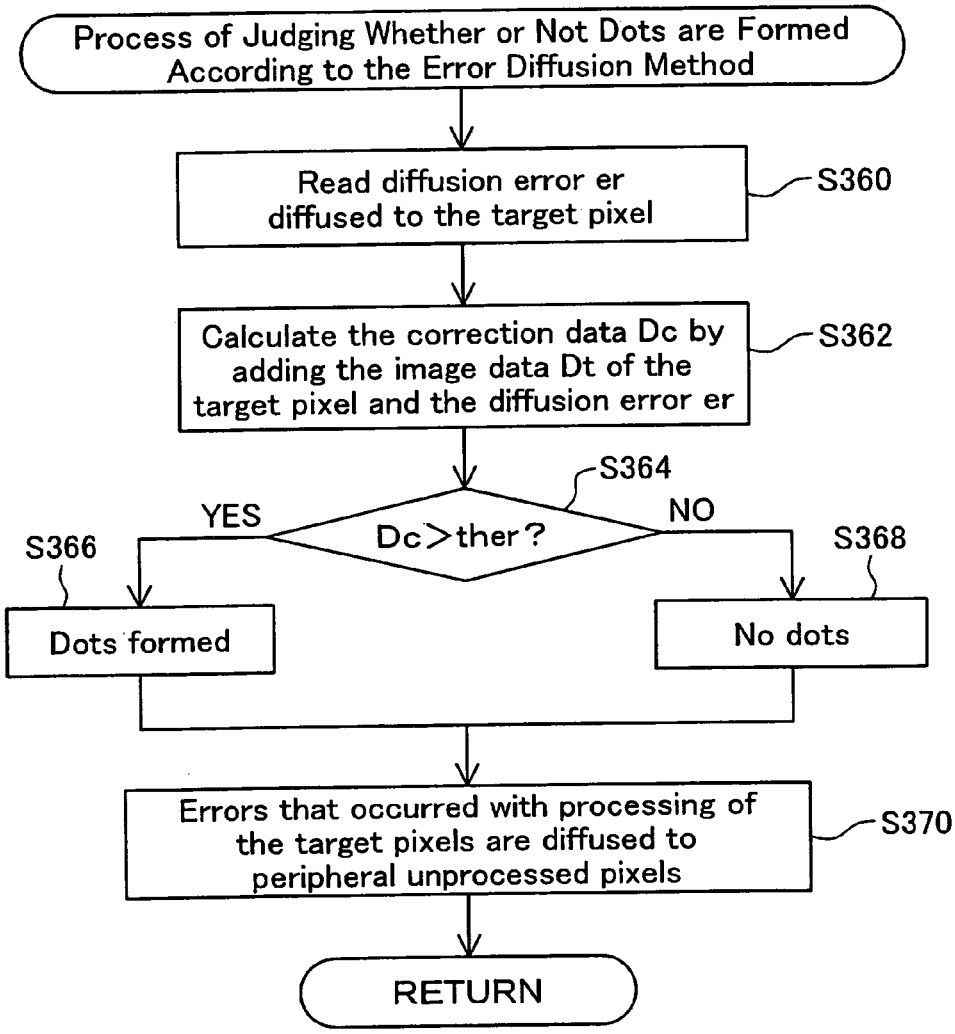
FIGS. 14 (*a*) and 14 (*b*) are explanatory diagrams that show the contents of a first and second error diffusion process for the first embodiment of the present invention.

FIGS. 14 (*a*) and 14 (*b*) are explanatory diagrams that show the contents of the first and second error diffusion processes for the first embodiment of the present invention. FIG. 14 (*a*) is a flow chart that shows the flow of the error diffusion process. FIG. 14 (*b*) is an explanatory diagram that shows the error weighting coefficient diffused to the peripheral pixels as the error diffusion method. With the example in FIG. 14 (*b*), it is a prerequisite that the pixels of interest shift in the rightward direction of the main scan.

A first error diffusion and a second error diffusion are prepared in advance for the error diffusion method. With this embodiment, as the first error diffusion weighting coefficient, the Jarvis, Judice & Ninke type is used, and as the second error diffusion weighting coefficient, the Floyd & Steinberg type is used.

With the first error diffusion, there is broad error diffusion to 12 pixels, so higher image quality can be anticipated compared to the second error diffusion. Meanwhile, with the second error diffusion, error is diffused only to four pixels, so compared to the first error diffusion, processing speed is faster.

At step S360, the gradation-reduction module 99 reads the diffusion error er diffused from other multiple pixels for which processing has already been done on the pixels of interest. At step S362, the gradation-reduction module 99 reads the pixel data Dt of the pixels of interest, and also adds the diffusion error er to the read pixel data Dt and generates the correction data Dc. The image data Dt is the medium dot level data LVM with this example.

At step S364, the gradation-reduction module 99 compares the correction data Dc with a preset threshold value Thre. As a result, when the correction data Dc is greater than the threshold value Thre, a determination is made to form dots (step S366). Meanwhile, when the correction data Dc is smaller than the threshold value Thre, a determination is made to not form dots (step S368).

At step S370, the gradation-reduction module 99 calculates the gradation error and also diffuses the error to the peripheral unprocessed pixels. The gradation error is the difference between the correction data Dc and the actual gradation value that occurs due to determination of whether or not to form dots. For example, if the gradation value of the correction data Dc is "223," and the gradation value that actually occurs due to dot formation is 255, then the gradation error is "−32" (=233-255).

The gradation error is diffused to the peripheral unprocessed pixels using the weighting coefficient of the second error diffusion (FIG. 14 (*b*)). For example, an error of "−14" (=−32×7/16) is diffused to the right edge pixels of the pixels of interest. In this way, when the error diffusion is completed, when it is determined that dots will be formed, the process returns to step S282 (FIG. 10), and when it is determined that dots will not be formed, the process returns to step S260.

At steps S260 and S270, the same process as for the medium dots is performed on the small dots. However, for the error diffusion method, the first error diffusion is used instead of the second error diffusion. When the above process is performed for all pixels for all the inks (step S290), the process advances to step S300 (FIG. 8).

At step S300, the print data generating module 100 realigns the dot data that shows the dot formation status for each pixel in the data order to be transferred to the color printer 20, and is output as the final print data PD. The print data PD includes the raster data that shows the dot recording status during each main scan and the data that shows the sub scan feed volume.

In this way, when the dot gradation count is four gradations, the ordered dither method is used for the large dot binarization process, and the second error diffusion and the first error diffusion are respectively used for the medium dot and small dot binarization processes. In this way, a binarization process is used for which the image quality is higher the smaller the dot, for which dot dispersibility has a relatively large effect on image quality, so both fast processing speed and high image quality are realized.

Figure 15:
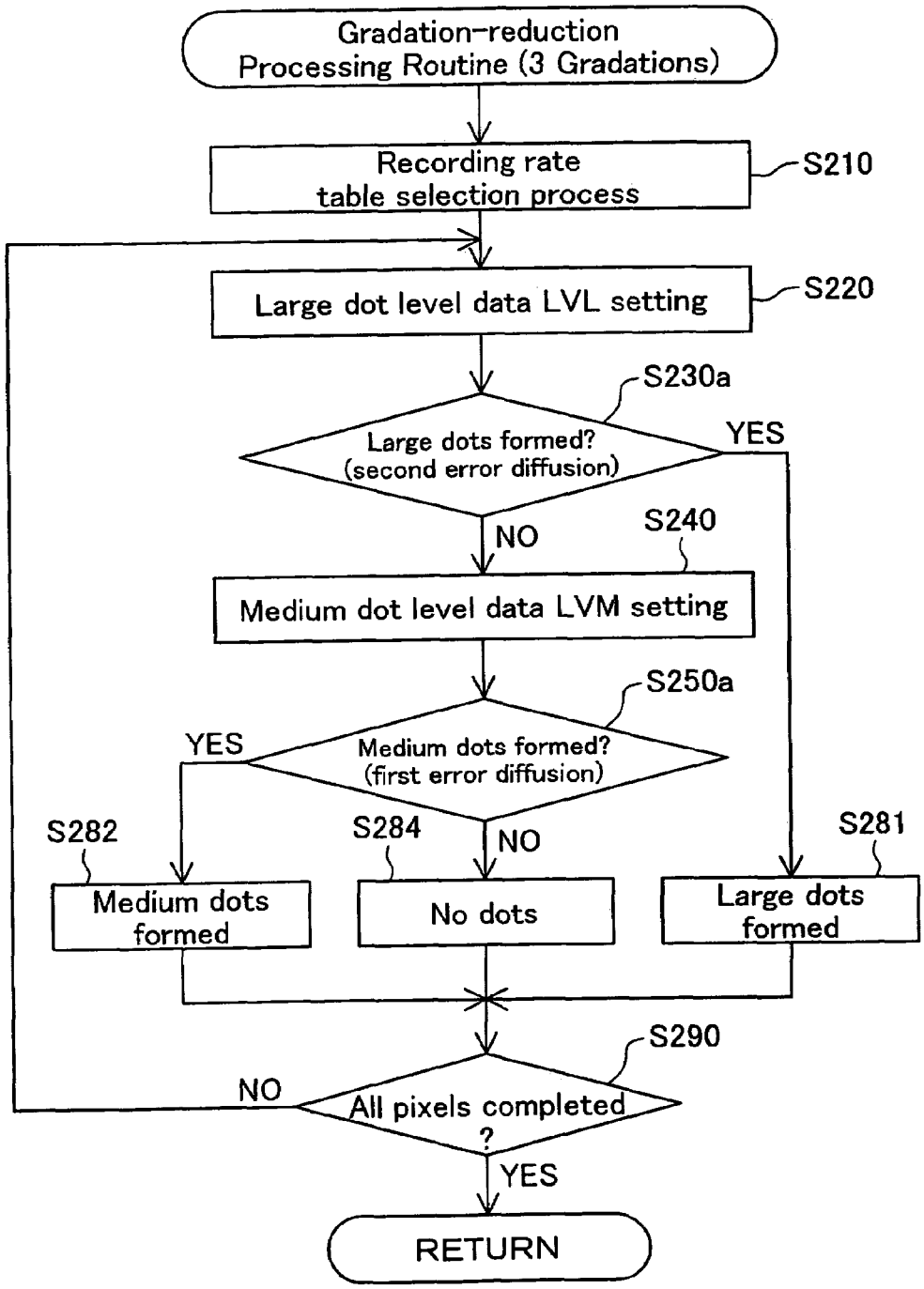
FIG. 15 is a flow chart that shows the flow of the gradation-reduction process when the number of gradations determined at step S130 is three gradations.

FIG. 15 is a flow chart that shows the flow of the gradation-reduction process when the gradation count determined at step S130 (FIG. 8) is three gradations. With this flow chart, the three steps S260, S270, and S283 for forming small dots are eliminated, and the point that the binarization processing method for determining whether or not to form large dots and small dots is also different from the flow chart of FIG. 10. Because of this, the steps S230 and S250 that are the process for determining whether to form large dots and medium dots are respectively changed to steps S230*a* and S250*a*.

The reason that the three steps S260, S270, and S283 for forming small dots are eliminated is because when the determined gradation count is three gradations, gradations are expressed without using small dots. These three gradations are expressed with the three gradations of "no dots are formed," "medium dots are formed," and "large dots are formed."

Meanwhile, the reason that the binarization processing method for determining whether or not large dots and medium dots are formed is changed is in order to suppress the degradation of image quality due to small dots not being formed.

Figure 16:
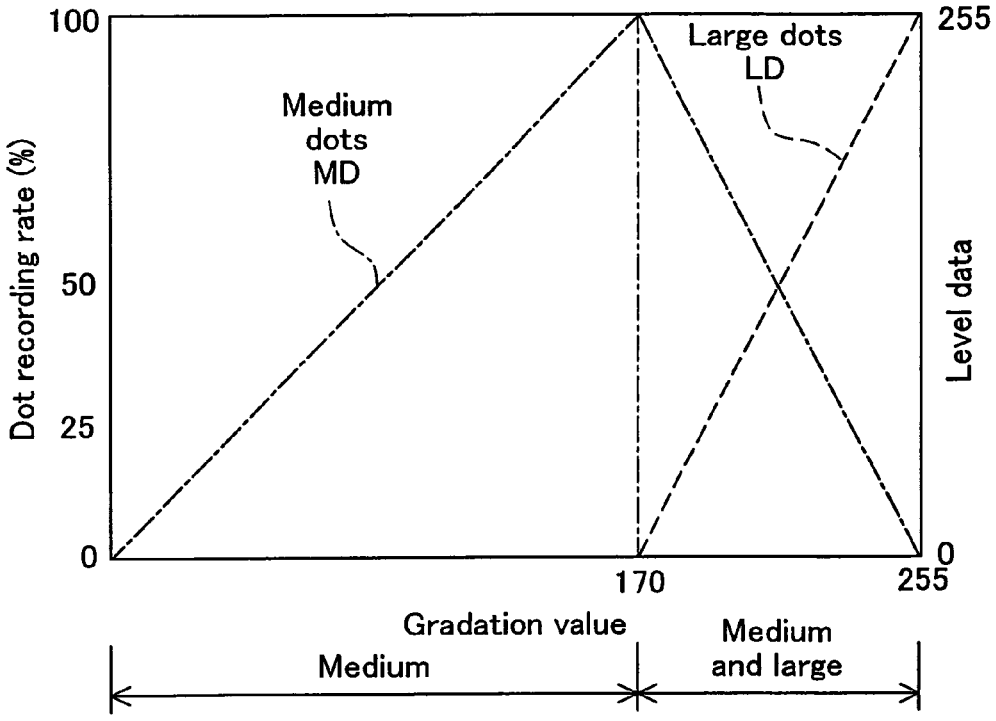
FIG. 16 is an explanatory diagram that shows two types of dot recording rate tables when the determined number of gradations is three gradations.

FIG. 16 is an explanatory diagram that shows two types of dot recording rate tables for when the determined gradation count is three gradations. This figure shows the dot recording rate table for three gradations which stores the dot recording rates MD and LD for each size large and medium. As we can see from this figure, for the relatively low gradation values, we can see that medium dots are formed individually. This is because compared to the case of four gradations when medium dots are always formed together with small dots, in the case of three gradations for which medium dots are often formed individually, the medium dot dispersibility has a relatively big effect on image quality. Similarly, the large dot dispersibility for three gradations also has a bigger effect on image quality than with four gradations.

The binarization processing method for each dot size is performed based on the correspondence table (FIG. 9 (*c*)) that is predetermined for each gradation count at step S140 (FIG. 8). With this correlation, large dots and medium dots have their respective sizes regarded as one size smaller medium dots and small dots, and the binarization processing methods are set. In specific terms, the second error diffusion is used for the large dot binarization process, and the first error diffusion is used for the medium dot binarization process. By doing this, it is possible to suppress degradation of image quality due to not using small dots.

Figure 17:
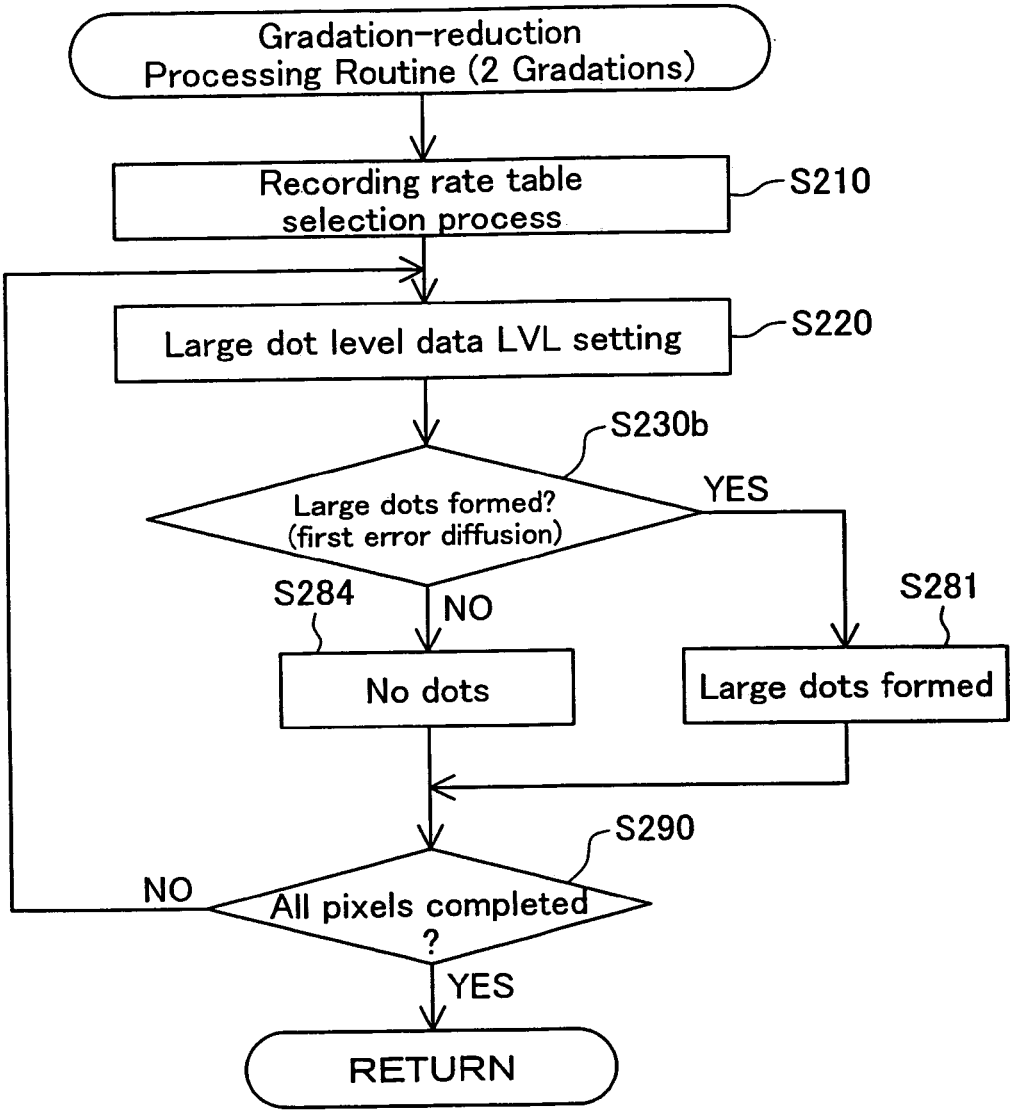
FIG. 17 is a flow chart that shows the flow of the gradation-reduction process in cases when the determined number of gradations is two gradations.

FIG. 17 is a flow chart that shows the flow of gradation-reduction processing for when the gradation count determined at step S130 (FIG. 8) is two gradations. With this flow chart, a further three steps S240, S250*a*, and S282 for forming medium dots are eliminated, and the point that the binarization method for determining whether or not medium dots are formed is changed is also different from the flow chart of FIG. 15. Because of this, the step S250*a* which is the process for determining whether or not medium dots are formed is changed to step S250*b*.

Figure 18:
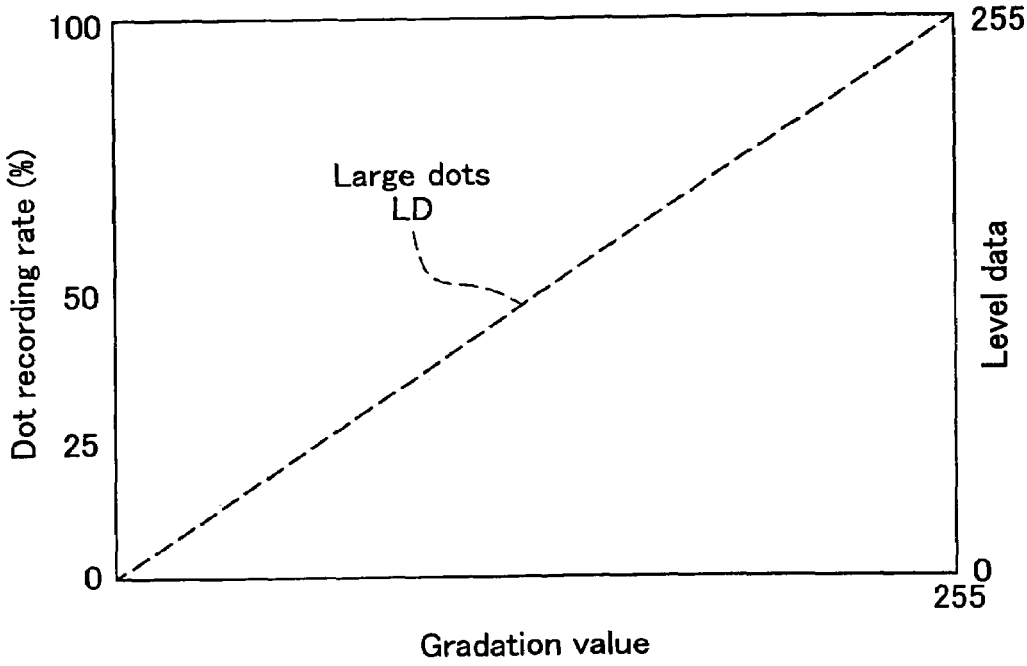
FIG. 18 is an explanatory diagram that shows the large dot's dot recording rate table in cases when the determined number of gradations is two gradations.

FIG. 18 is an explanatory diagram that shows the dot recording rate table for large dots when the determined gradation count is two gradations. This figure shows a dot recording rate table for two gradations that stores the dot recording rate LD for large dots. As can be seen from this figure, we can see that large dots are formed individually for all the gradation values. Because of this, large dot dispersibility has a big effect on image quality.

The large dot binarization processing method is performed based on the correlation (FIG. 9 (*d*)) that was predetermined for each gradation count at step S240 (FIG. 8). With this correlation, large dots are regarded as two sizes smaller small dots, and the binarization processing method is set. As a result of this, the first error diffusion is used for the large dot binarization process. By doing this, it is possible to suppress degradation of image quality due to not using medium dots and small dots.

In this way, with this embodiment, according to the shift number which is the number of unused dot types for which the size is smaller than each of the dot sizes, each size dot is regarded as a dot the same number of sizes smaller as the shift number, and based on tables set in this way, the binarization processing method is determined, so it is possible to suppress degradation of image quality due to worsening of dot dispersibility due to not using part of the dots.

C. First Embodiment Variation

With the first embodiment described above, binarization processing methods with different processing contents for each dot size were set, but for example as shown in FIGS. 19 (*a*), 19 (*b*), and 19 (*c*), it is also possible to structure this so that two types of binarization processing are set for the three types of dot sizes. With the present invention, it is acceptable as long as it is possible to use a plurality of binarization processing methods for which the processing contents differ.

With the first embodiment described above, printers for which the dot gradation count is four gradations, three gradations, and two gradations each have prepared in advance tables for each gradation count which can be expressed for each pixel (FIG. 9 (*b*), FIG. 9 (*c*), FIG. 9 (*d*)), but it is also possible to structure this so that a table is only prepared for four gradations (FIG. 9 (*a*)) which is the maximum gradation count.

In this kind of case, the gradation-reduction module 99 can be structured so that for determining the binarization processing method, according to the shift number which is the number of types of unused dots for which the size is smaller than each of the dot sizes, each size dot is regarded and handled as a dot that is smaller by the number of sizes that matches the shift number. This can be realized by changing the label (data name or flag) of the data that is subject to gradation-reduction processing, for example.

The determination of the binarization processing method performed with the present invention can be structured such that ultimately, according to a shift number that is the number of types of unused dots for which the size is smaller than each size dot, each size dot is regarded as a dot that is smaller by the number of sizes of the shift number, and the binarization processing method is determined based on a table for the maximum gradation count.

Figure 20:
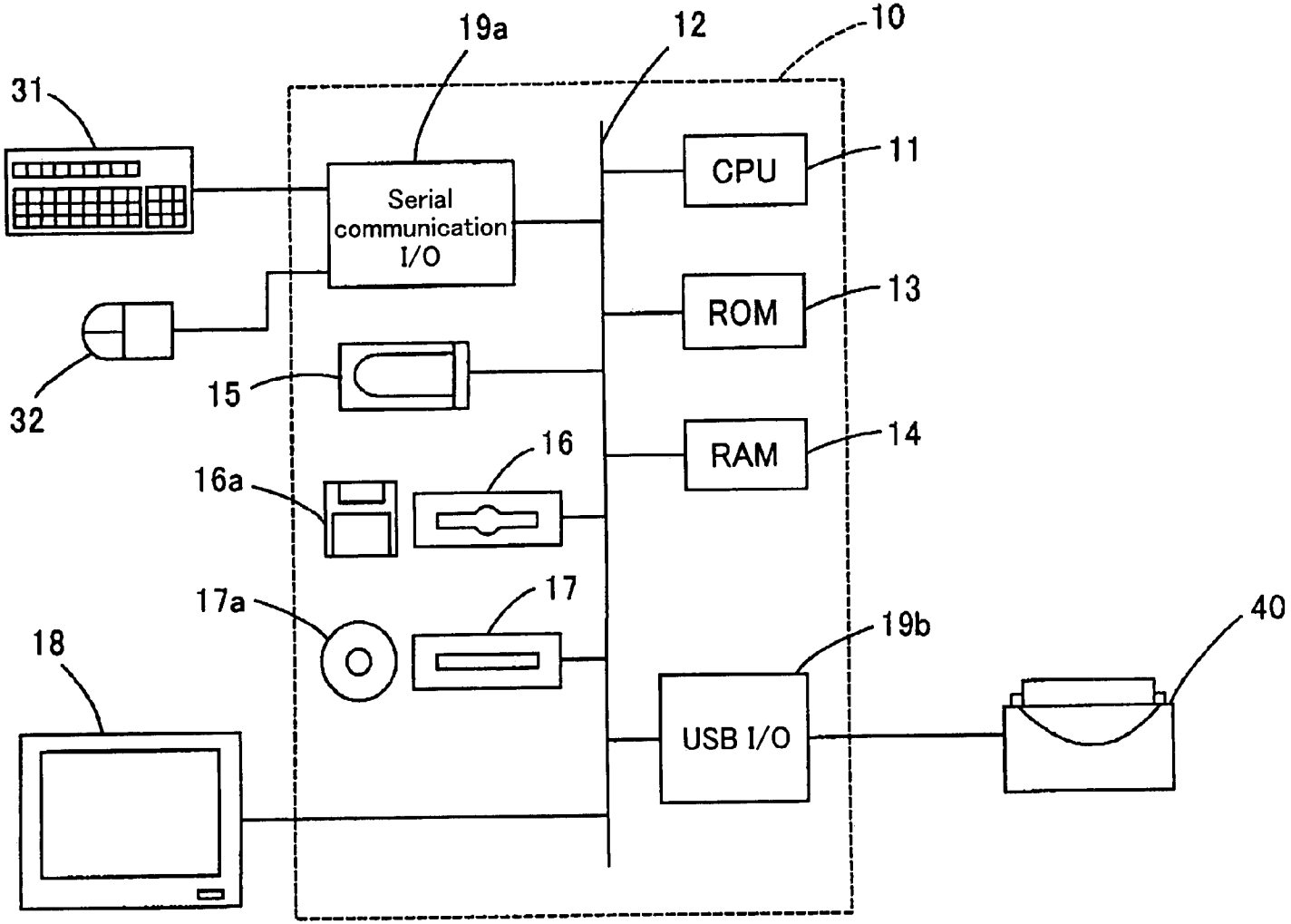
FIG. 20 is a block diagram that shows the structure of a printing system of the second embodiment of the present invention.

D. Structure of the Printing Device of the Second Embodiment of the Present Invention FIG. 20 is a block diagram that shows the structure of the printing system for the second embodiment of the present invention. For this embodiment, the print control apparatus consists of a printer and a computer that controls the printer. The computer 10 is equipped with a program executing environment consisting of a ROM 13 and a RAM 14, and it is possible to execute a specified program by sending and receiving data via a system bus 12.

Connected to the system bus 12 as external storage devices are a hard disk drive (HDD) 16, a flexible disk drive 16, and a CD-ROM drive 17, the OS 20 and the application program (APL) 25, etc. stored in the HDD 15 are transferred to the RAM 14 and the aforementioned program is executed. Operation input devices such as a keyboard 31 and a mouse 32 are connected to the computer 10 via a serial communication I/O 19*a*, and a display 18 for display is connected via a video board that is not illustrated.

Furthermore, the printer 40 may be connected via a USB I/O 19*b*. Note that as this computer 10, it is possible to realize a variety of embodiments with it possible to use a so-called desktop type computer, a notebook type, or a mobile compatible type. Also, the connection interface of the computer 10 and the printer 40 does not have to be limited to the item described above, as it is also possible to use various connection formats such as a serial interface or SCSI connection, etc., and the same is also true for any connection format developed in the future.

With this example, each program type is stored in the HDD 15, but the storage medium is not limited to this. For example, it can be a flexible disk 16*a* or a CD-ROM 17*a*. The programs stored in these storage media are read by the computer 10, and installed in the HDD 15. After installation, these are read on the RAM 14 via the HDD 15, resulting in control of the computer. The storage media are also not limited to these, and can also be a photo magnetic disk, etc. As a semiconductor device, it is also possible to use non-volatile memory, etc. such as a flash card, and in cases of accessing an external file server via a modem or communication circuit and downloading, it is also possible for the communication circuit to be a transmission medium for the present invention to be used.

Figure 21:
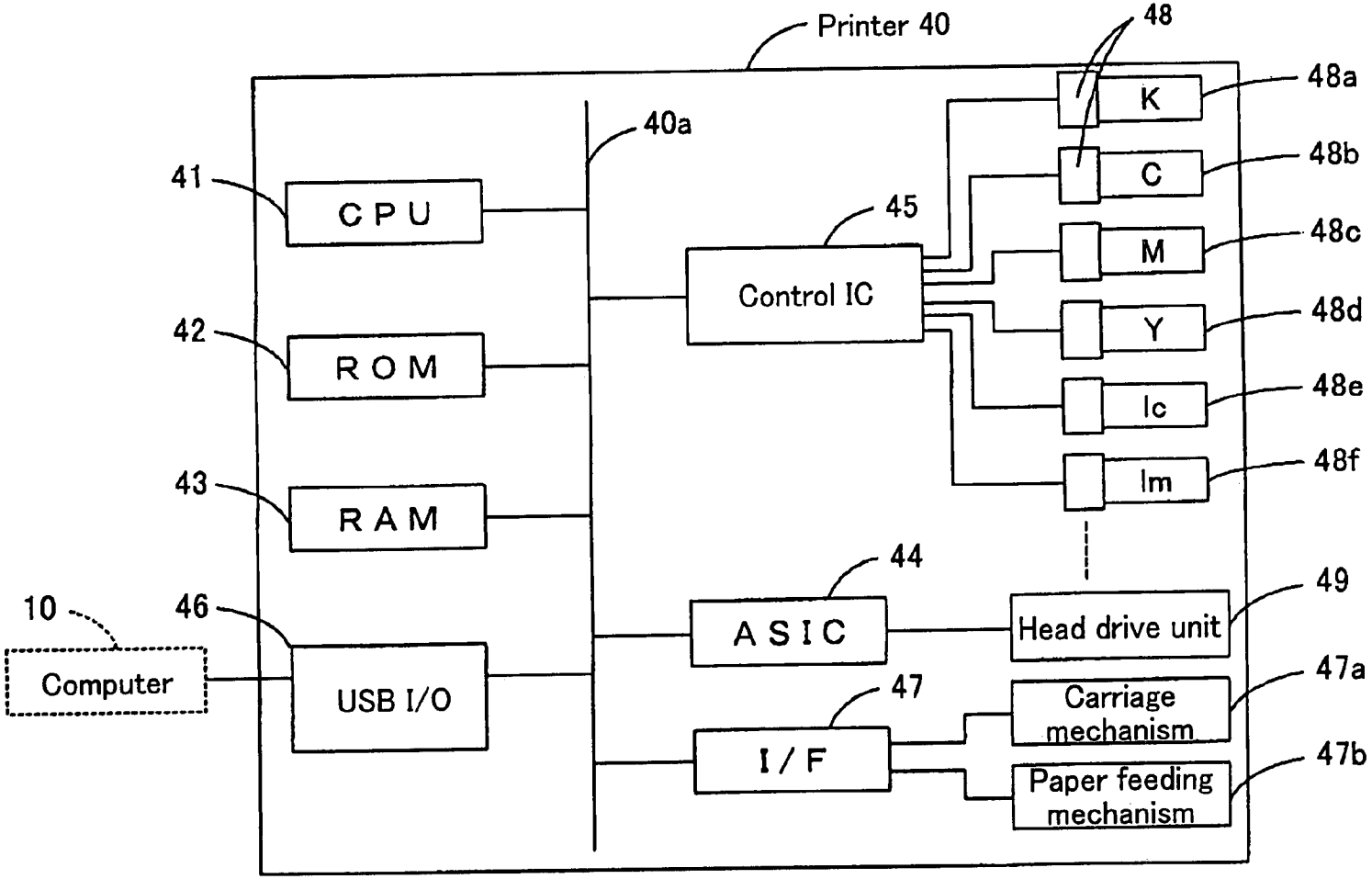
FIG. 21 is a diagram that shows the schematic hardware structure of a printer of the second embodiment of the present invention.

FIG. 21 is a block diagram that shows the internal structure of the printer 40 for the second embodiment of the present invention. In this figure, connected to the bus 40*a* provided inside the printer 40 are a CPU 41, a ROM 42, a RAM 43, an ASIC 44, a control IC 45, a USB I/O 46, and an interface (I/F) 47, etc. for transmitting image data or drive signals, etc. Then, the CPU 41 uses the RAM 43 as a work area while also controlling each part according to the program written to the ROM 42. The ASIC 44 is a customized IC for driving a printing head which is not illustrated, and while sending and receiving specified signals with the CPU 41, it performs processing for driving the printing head. It also outputs application voltage data to the head drive unit 49.

The head drive unit 49 is a circuit consisting of a dedicated IC and a drive transistor, etc. This head drive unit 49 generates an application voltage pattern to the piezo element that is incorporated in the printing head based on the application voltage data input from the ASIC 44. The printing head is connected by tubes for each ink to cartridge holder 48 in which can be incorporated ink cartridges 48*a* to 48*f* that are filled with six colors of ink, and this receives a supply of each ink. The piezo element is an electrostriction component that is capable of expanding and contracting by distorting the crystal structure when voltage is applied, and is placed on the outside of the wall surface of the communicating path that links from each ink tube to the nozzle. Then, by the piezo element expanding and contracting according to the applied voltage pattern, the wall surface of the communicating path is varied, and the communicating path volume is changed. Therefore, when the volume of the communicating path has been decreased, the decreased portion of ink is pressed out and ejectn outside from the nozzle.

The control IC 45 is an IC that controls the cartridge memory which is non-volatile memory that is built into each ink cartridge 48*a* to 48*f*, and with control by the CPU 41, reading of the information of the ink color or remaining amount recorded in the cartridge memory as well as updating of the ink remaining volume information, etc. are done. The USB I/O 46 is connected with the USB I/O 19*b* of the computer 10, and the printer 40 receives data transmitted from the computer 10 via the USB I/O 46. Connected to the I/F 47 are a carriage mechanism 47*a* and a paper feeding mechanism 47*b*. The paper feeding mechanism 47*b* consists of a paper feed motor and a paper feed roller, etc., and it feeds in sequence a printing recording medium such as printing paper, etc. and performs sub scanning. The carriage mechanism 47*a* is equipped with a carriage that incorporates a printing head, moves the carriage back and forth, and does a main scan of the printing head.

Figure 22:
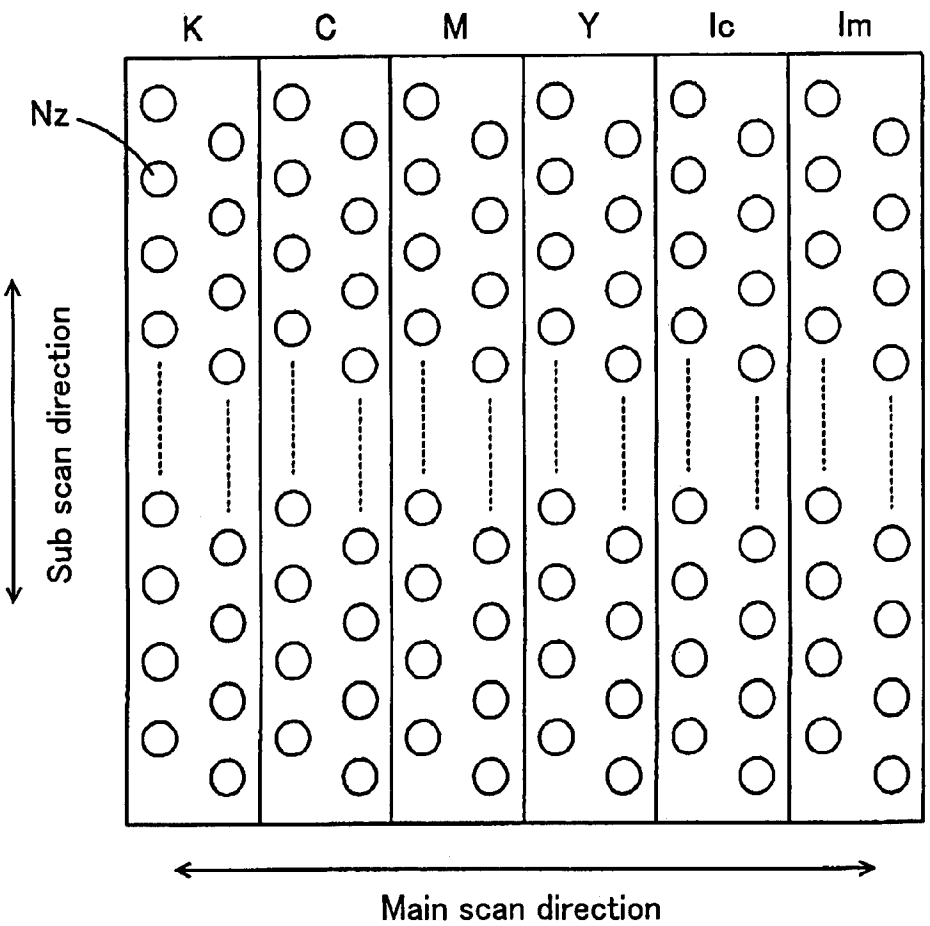
FIG. 22 is a diagram that shows the ink ejecting unit of the ink head of the second embodiment of the present invention.

FIG. 22 shows the structure of the ink ejecting unit of the printing head for the second embodiment of the present invention. In this figure, on the ink ejecting unit of the printing head are formed to be aligned in the main scan direction of the printing head six colors of nozzle arrays that eject each of the six colors of inks, and for each of the nozzle arrays, a plurality of nozzles Nz (e.g. 64 items) is arranged at a constant interval in the sub scan direction. Note that for this embodiment, cyan ink (C ink), magenta ink (M ink), yellow ink (Y ink), black ink (K ink), light cyan ink (lc ink), and light magenta ink (lm ink) are used. However, the nozzles Nz for this embodiment are able to eject ink so as to form dots of three types of sizes (meaning N=3 for the present invention) of large, medium, and small on a printing medium. Following, we will explain the theory for this.

Figure 23:
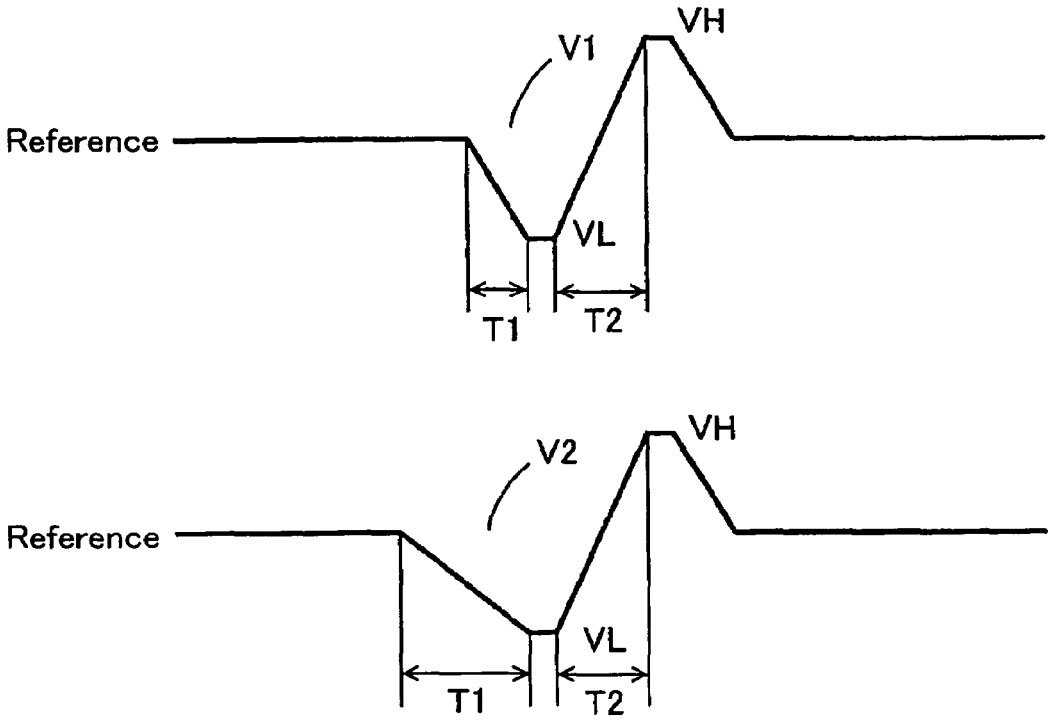
FIG. 23 is a graph that shows the voltage pattern applied to the piezo element of the second embodiment of the present invention.

First, by separating use of the voltage patterns applied to the aforementioned piezo element, the volume of ink ejectn from the nozzle Nz is changed. FIG. 23 shows an example of a voltage pattern of the second embodiment of the present invention. In this figure, the upper level shows the voltage pattern V1 for ejecting a low volume of ink, and the lower level of the figure shows a voltage pattern V2 for ejecting a large volume of ink. Both voltage patterns V1 and V2 drop from the reference voltage to voltage VL at time T1, and rise from the reference voltage to a high voltage VH at time T2. Note that with a voltage higher than the reference voltage, the piezo element expands and the volume of the communicating path decreases, and with a voltage lower than the reference voltage, the piezo element contracts, and the volume of the communicating path increases. When the voltage pattern V1 and the voltage pattern V2 are compared, the time T1 of the voltage pattern V1 is shorter. Specifically, the applied voltage rapidly drops.

When the applied voltage drops, the piezo element contracts, and the volume of the communicating path increases, so the communicating path ink pressure decreases. Basically, the pressure that dropped due to drawing in of ink within the ink cartridges 48*a* to 48*f* up to the communicating path is recovered, but as with the voltage pattern V1, when there is a rapid drop in the applied voltage, before the voltage is recovered, the volume of the communication path is decreased at time T2. When this is done, even during compression at time T2, the ink pressure within the communicating path is low. Meanwhile, because for the voltage pattern V2, the time T1 is long, it is possible to recover the dropped voltage. Therefore, for the voltage pattern V2, it is possible to increase the ink pressure within the communicating path at time T2. From the above, by applying the voltage pattern V1 and making the ejectn ink drops smaller, it is possible to enlarge the ink drops ejectn by applying the voltage pattern V2.

Therefore, if small ink drops are ejectn by applying the voltage pattern V1, it is possible to form small dots on the recording medium, and if large ink drops are ejectn by applying the voltage pattern V2, it is possible to form medium dots that are larger than the small dots on the recording medium. Meanwhile, large dots are formed by applying both the voltage pattern V1 and the voltage pattern V2.

Figure 24:
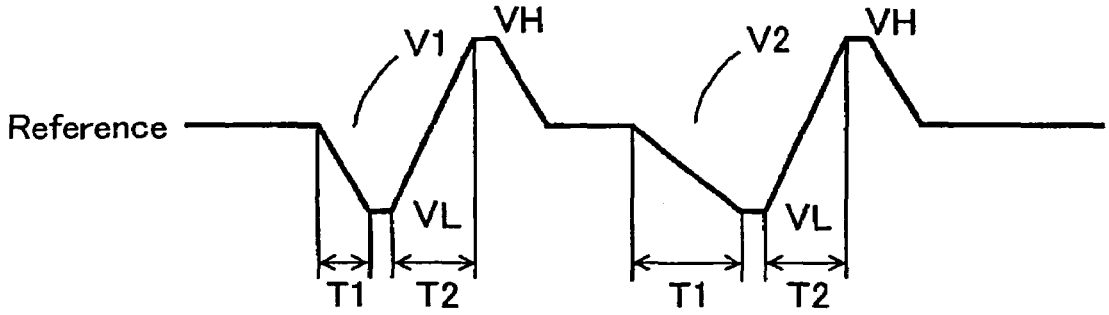
FIG. 24 is a graph that shows the voltage pattern applied to the piezo element of the second embodiment of the present invention.

FIG. 24 shows a voltage pattern for forming large dots for the second embodiment of the present invention. In this figure, the voltage pattern V1 is applied, and after that, the voltage pattern V2 is applied. Specifically, large dots are formed by small ink drops for forming small dots and by large ink drops for forming medium dots. Here, a printing head that is equipped with nozzles Nz for ejecting ink performs a main scan, so the ejecting position in relation to the recording medium of the small ink drops and large ink drops ejectn in sequence are skewed in the main scan direction. In other words, the large ink drops that are ejectn later are ejectn at a position that is advanced in the main scan direction.

Small ink drops and large ink drops have a ejecting direction (facing the recording medium) speed components that faces the recording medium and a main scan direction speed component according to inertia. Note that the main scan direction speed component of the small ink drops and large ink drops are equivalent. As described above, since small ink drops are ejectn using low pressure, the ejecting direction speed component is smaller than that of the large ink drops. Therefore, the time until the small ink drops land on the printing medium is longer than that of the large ink drops, and it is possible to have these land at a position advanced in the main scan direction more than that of the large ink drops by that amount, so it is possible to offset the skew in the ejecting position of the small ink drops and the large ink drops. Specifically, it is possible to have the small ink drops and large ink drops land in the same position, and to form large dots that are a synthesis of these.

For this embodiment, we realized formation of large dots, medium dots, and small dots on the recording medium using the method noted above, but it is also possible to form large dots, medium dots, and small dots using a different method. For example, it is also possible to provide a voltage pattern for forming large dots with one eject in addition to the aforementioned voltage patterns V1 and V2. Of course, the formed dots are not limited to being the three types of dots of large dots, medium dots, and small dots, and it is possible to form a wider variety of dot sizes.

Figure 25:
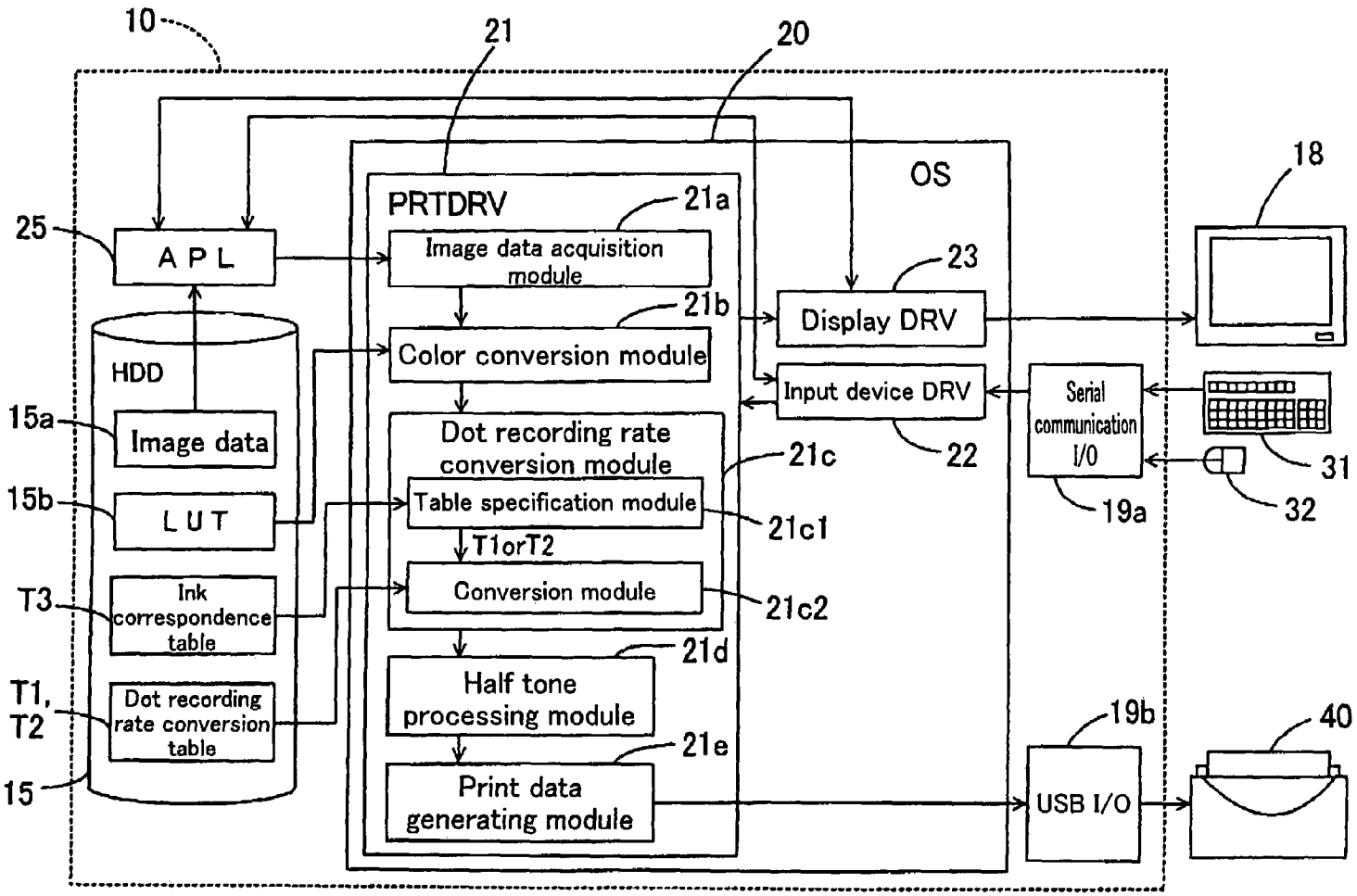
FIG. 25 is a diagram that shows the schematic structure of the main control system of the printing device of the second embodiment of the present invention.

FIG. 25 shows a schematic structural diagram of the main control system of the printing device that is realized by a computer for the second embodiment of the present invention. The aforementioned printer 40 is controlled by the printer driver that is installed in the computer 10, and executes printing, and the printer driver functions as the print control apparatus for the computer 10. In specific terms, the printer driver (PRTDRV) 21, the input device driver (DRV) 22, and the display driver (DRV) 23 are incorporated in the OS 20. The display DRV 23 is a driver that controls the display of image data, etc. on the display 18, and the input device DRV 22 receives code signals from the aforementioned keyboard 31 or mouse 32 input via the serial communication I/O 19*a* and accepts a specified input operation.

The APL 25 is an application program that can execute color image retouching, etc., and the user, under the execution of the concerned APL 25, operates the aforementioned operation input device and can give printing instructions such as to retouch an image shown by the image data 15*a*. When printing instructions are given using the APL 25, the aforementioned PRTDRV 21 is driven, and the color conversion module 21*b* executes color conversion processing on the image data 15*a* acquired by the image data acquisition module 21*a*. By performing the color conversion process, the image data 15*a* is converted to ink gradation data expressed by the gradation values of C, M, Y, K, lc, and lm inks which can be used by the printer 40. Then, print data is created by the dot recording rate conversion module 21*c* executing a specified dot recording rate conversion process and the half tone processing module 21*d* performing a specified half tone process, and printing is executed by the print data being sent to the aforementioned printer 40.

Figure 26:
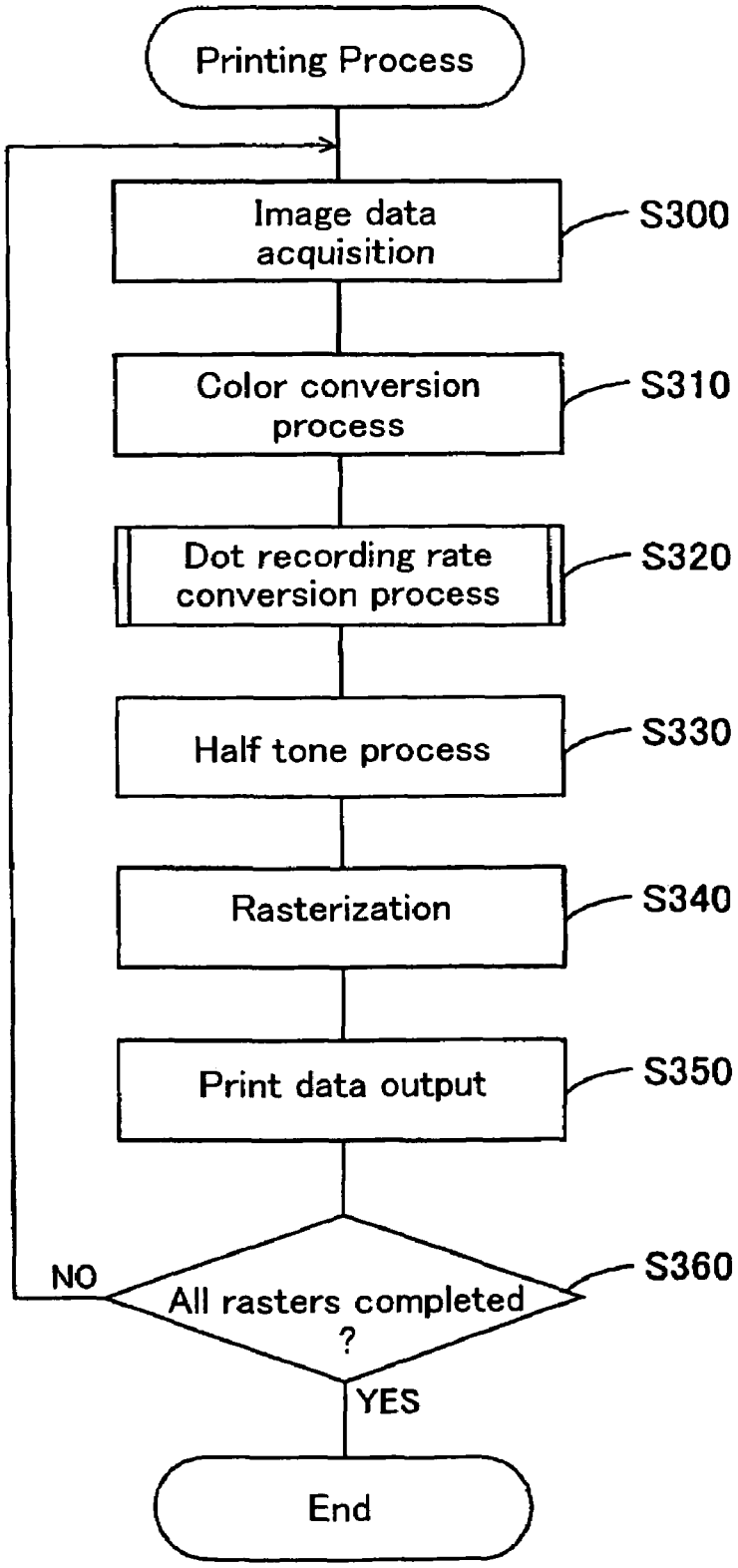
FIG. 26 is a flow chart of the printing process of the second embodiment of the present invention.

E. Print Data Generating Process for the Second Embodiment of the Present Invention FIG. 26 shows a flow chart of the flow of the printing process for the second embodiment of the present invention. With this embodiment, the aforementioned PRTDRV 21 is equipped with the image data acquisition module 21*a*, the color conversion module 21*b*, the dot recording rate conversion module 21*c*, the half tone processing module 21*d*, and the print data generating module 21*e* shown in FIG. 25 to execute printing. When the user gives instructions for executing printing using the aforementioned APL 25, printing processing is executed according to the flow shown in FIG. 26. When the printing processing starts, at step S300, the aforementioned image data acquisition module 21*a* acquires the image data stored in the aforementioned RAM 14.

When this is done, at step S310, the image data acquisition module 21*a* activates the aforementioned color conversion module 21*b*. The color conversion module 21*b* is a module that converts the RGB data to data expressed in gradation values of C, M, Y, K, lc, and lm ink, and at the same step S310, while referencing a color conversion table which stipulates the correlation of the RGB gradations and the C, M, Yk K, lc, and lm ink gradation values, it converts each dot data of the aforementioned image data 15*a* to ink gradation data expressed by gradations of C, M, Y, K, lc, and lm ink. The ink gradation data expressed by the C, M, Y, K, lc, and lm ink gradations is transferred to the dot recording rate conversion processing module 21*c*, and dot recording rate conversion processing is performed.

Figure 27:
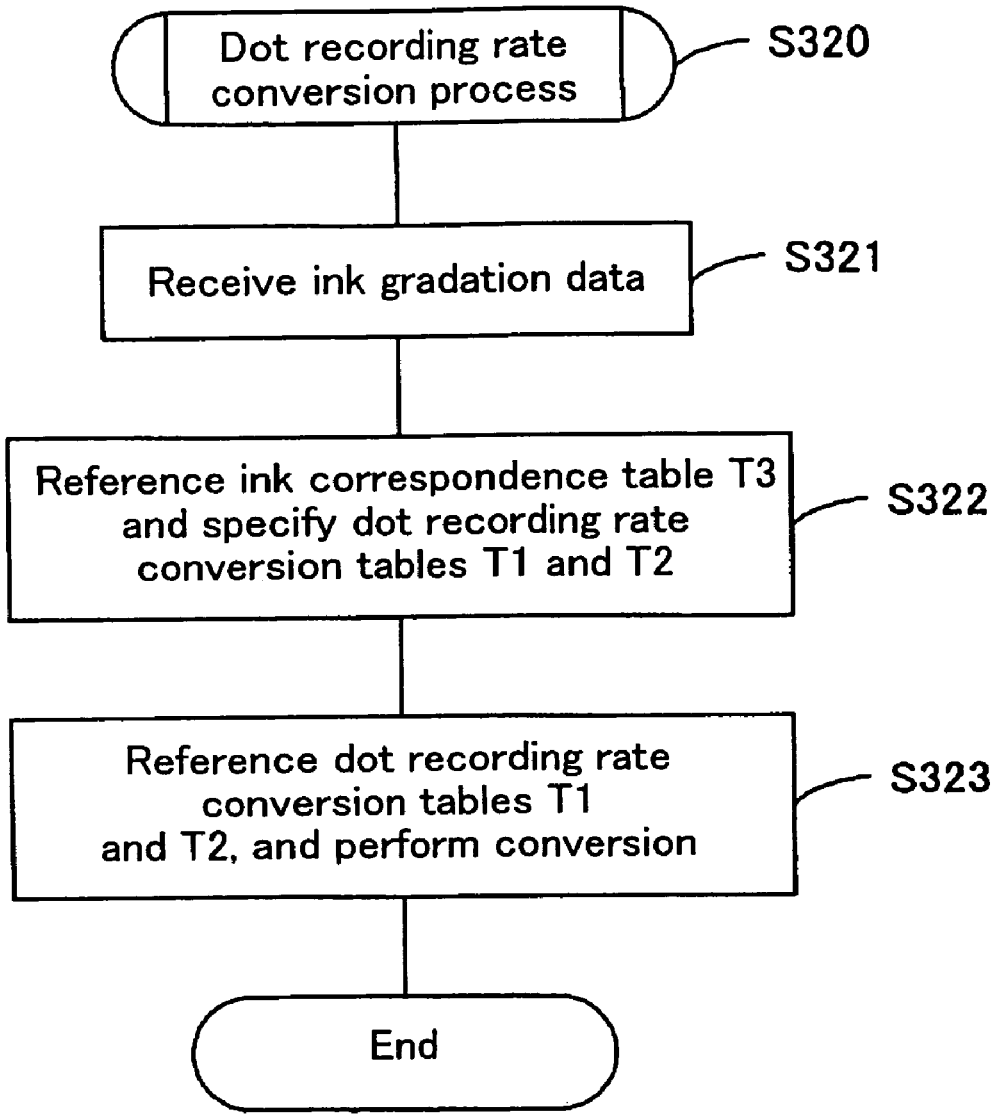
FIG. 27 is a flow chart of the dot recording rate conversion process of the second embodiment of the present invention.

FIG. 27 is a flow chart that shows the flow of the dot recording rate conversion process for the second embodiment of the present invention. First, at step S321, ink gradation data is received from the color conversion module 21*b*. Next, at step S322, dot recording rate conversion tables T1 and T2 are specified in correspondence to the inks.

FIG. 28 shows the ink correspondence table T3. In this figure, the ink correspondence table T3 stipulates the dot recording rate conversion tables T1 and T2 that are referenced when performing dot recording rate conversion for each of the inks C, M, Y, K, lc, and lm. For example, it is stipulated that when performing dot recording rate conversion for the C and M inks, the dot recording rate conversion table T1 is referenced, and when performing dot recording rate conversion for the Y, K, lm, and lc inks, the dot recording rate conversion table T2 is referenced. At step S322, by the table judgment module 21*c*1 referencing the ink correspondence table T3, the dot recording rate conversion tables T1 and T2 for referencing each of the inks are specified. Then, at step S323, either of the dot recording rate conversion tables T1 and T2 similarly specified by the conversion module 21*c*2 is referenced and dot recording rate conversion is performed.

FIG. 29 shows an example of a dot recording rate conversion table of the second embodiment of the present invention. In this figure, there are two dot recording rate conversion tables T1 and T2. For dot recording rate conversion tables T1 and T2, dot recording rates corresponding to the gradation values of each ink are stipulated for each of the three types (N=3) of large dots, medium dots, and small dots. Therefore, it is possible to specify a dot recording rate for each of the large dots, medium dots, and small dots from the ink gradation values. For example, when the dot recording rate conversion table T1 is referenced, it is possible to specify a dot recording rate for each dot size as in that the dot recording rate for large dots corresponding to the ink gradation value 128 is 24%, the dot recording rate for the medium dots is 32%, and the dot recording rate for the small dots is 40%. Here, the dot recording rate means the ratio (coverage rate) at which dots are formed on pixels within an area when printing the close typesetting area of a certain gradation value.

By working as described above, the dot recording rate conversion processing module 21*c* references the dot recording rate conversion table, and by doing this, converts ink gradation data to dot recording rate data expressed as dot recording rates for each dot of large dots, medium dots, and small dots. To say this another way, a process of separating ink gradation values into dot recording rates for each dot of large dots, medium dots, and small dots is performed. In particular, for the present invention, the different dot recording rate conversion tables T1 and T2 are divided for use for each ink according to the ink correspondence table T3.

Figure 30:
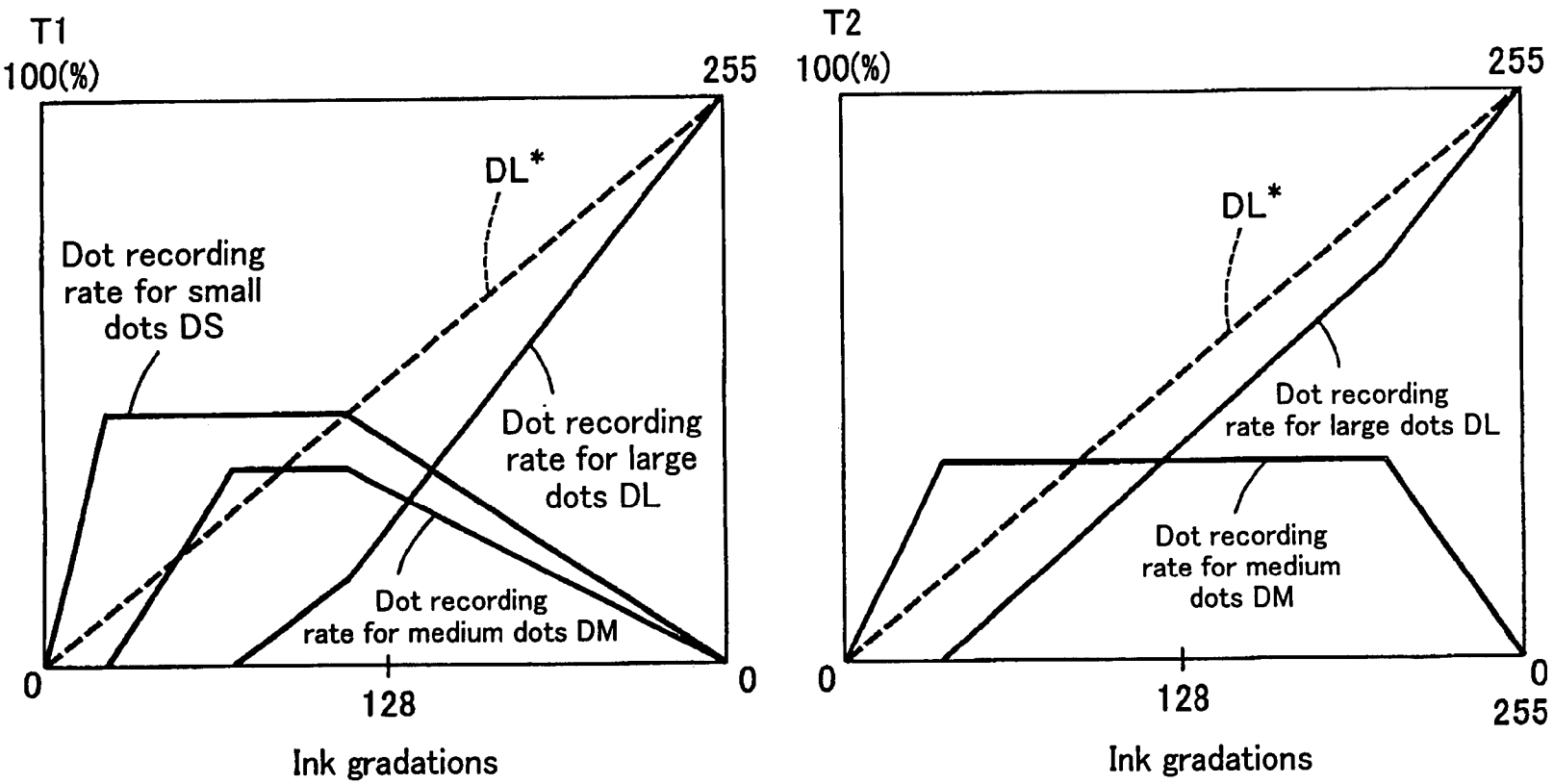
FIG. 30 is a graph that shows the dot recording rate conversion table of the second embodiment of the present invention.

FIG. 30 is a graph that compares the dot recording rate conversion tables T1 and T2 for the second embodiment of the present invention. In this figure, the vertical axis and the horizontal axis show respectively the dot recording rate and the ink gradation values, and the dot recording rates for the small dots, medium dots, and large dots are respectively shown as DS, DM, and DL. Also, a case of expressing each ink gradation only with large dots without forming small dots and medium dots is shown by the dotted line with the dot recording rate for large dots as DL*. Also, with this embodiment, the ratio of the area (coverage area) per dot of each dot formed on the recording medium is large dots: medium dots: small dots=4:2:1. With either of the dot recording rate conversion tables T1 and T2, the relationship below was established between the dot recording rates DS, DM, and DL of large dots, medium dots, and large dots.

$$DL+0.5DM+0.25DS=DL^* \quad (1)$$

Specifically, even if different dot recording rate conversion tables T1 and T2 are referenced, the coverage rate due to dots formed in relation to the same ink gradation are mutually equivalent.

Also, for the dot recording rate conversion table T1, the dot recording rate DS for small dots is described for the whole area of the ink gradation. Meanwhile, for the dot recording rate conversion table T2, the dot recording rate DS for small dots is not described for the whole area of the ink gradation. Specifically, the dot recording rate DS of the small dots is noted as 0% for the whole area of the ink gradation. To say this another way, the dot recording rate conversion table T1 is expressed by the dot recording rate of two types (meaning that N−M=2 for the present invention) of dot sizes which excludes small dots which are one type (meaning M=1 with the present invention) of dot size.

However, the aforementioned equation (1) is established for both dot recording rate conversion tables T1 and T2, so the coverage will not be different for the same ink gradation for both of these. Specifically, for the dot recording rate conversion table T2, the dot recording rate DS for small dots that is described in the dot recording rate conversion table T1 is substituted by the dot recording rates DL and DM for large dots and medium dots so that the coverage on the recording medium is not changed due to all the large size dots. By working in this way, it is possible to divide use of the different dot recording rate conversion tables T1 and T2 without changing the printing results.

The dot recording rate data expressed by the dot recording rate as described above is transferred to the half tone processing module 21*d* at step S330, and half tone processing is performed. Note that we explained the dot recording rate for the dot recording rate process in terms of a percentage, but because data is actually sent and received using electrical signals, the dot recording rate is expressed by 256 gradations. Here, we explained an example of half tone processing using the dither method. With the dither method, a dither matrix of a specified size (e.g. vertical 16 pixels×horizontal 16 pixels) for which a 0 to 255 threshold value is set randomly for each pixel is prepared, and the threshold values of this dither matrix and the dot recording rate of the dot recording rate data is compared for each of the pixels. Then, when the dot recording rate of the dot recording rate data is greater than the aforementioned threshold value, for the concerned pixel, the subject size dots will be formed. Then, by skewing the dither matrix in sequence, half tone processing is performed for the entire image data.

With this embodiment, since large dots, medium dots, and small dots each have a dot recording rate, the aforementioned comparison process is performed for each size dots. Also, to make it difficult for bias to occur with dot formation, it is preferable to prepare a different dither matrix for each of the large dots, medium dots, and small dots. By performing half tone processing, it is possible to make the information that each pixel has be only whether or not large dots are formed, whether or not medium dots are formed, and whether or not small dots are formed. Specifically, it is possible to convert to data that can be expressed using the ink ejecting unit of the printing head noted above. Here, for the Y, K, lc, and lm inks for which dot recording rate conversion was performed referencing the dot recording rate conversion table T2 for which the dot recording rate DS for small dots was not described (the gradation of the dot recording rate DS is 0 for all ink gradations) for the entire area of the ink gradations, the dot recording rate DS will not be greater than the threshold value for any of the pixels of the dither matrix. Therefore, for the Y, K, lc, and lm inks, dot formation data from which small dots are not formed at all is generated.

The print data generating module 21*e* receives the dot formation data, and at step S340, realigns this in the order used by the printer 40. Specifically, at the printer 40, the ejecting nozzle array shown in the aforementioned FIG. 22 is incorporated as the ink ejecting device, and with the concerned nozzle array, a plurality of eject nozzles are arranged in the sub scan direction, so data separated by a few dots in the sub scan direction is used simultaneously.

In light of this, of the data aligned in the main scan direction, items that are to be used simultaneously are realigned in the sequence for which they will undergo baffling simultaneously by the printer 40 and rasterized. After this rasterization, print data to which specified information such as the image resolution, etc. is attached is generated, and at step S350, this is output to the printer 40 via the aforementioned USB I/O 19*b*. At the printer 40, the image displayed on the aforementioned display 18 is printed based on the concerned print data. Then, at step S360, printing is completed by repeating the process after step S300 until it is judged that the above process has ended for all rasters.

With the printing process explained above, for the Y, K, lc, and lm inks that use the dot recording rate conversion table T2 at step S323, it is possible to perform printing without forming small dots. In this way, by not forming specific dots for specific inks, it is possible to obtain various advantages. For example, in cases when suitable formation is not possible of specific large dots due to physical properties inherent to an ink such as the ink viscosity, electric charge, surface tension, and specific gravity, etc., by not having that dot formed, it is possible to improve the image quality. As an example of when a dot cannot be formed suitably, there is the case of when the ink weight of ink drops for forming a specific size dot deviates from the target value, and there is large variation in the same weight. In this case, the size of the formed dots is not according to the target, so it is not possible to obtain the desired printing quality.

Note that when the ink weight deviates from the target value and the variation is small, it is possible to obtain suitable printing results by using the method disclosed in the Unexamined Patent 2001-158085. Specifically, by correcting the dot recording rate described in the dot recording rate conversion table, it is possible to have the ink weight come close to the target value. However, when the ink weight variation is large, it is not possible to solve the problem using this method. This is because when doing a test print, even when the ink weight is a suitable value, because there is fluctuation in the weight within the variation range, during printing, the weight becomes unsuitable. In contrast to this, with the present invention, by not having a specific dot for which there is great variation formed, it is possible to print using only dots for which the ink weight is stable, and thus to obtain stable printing quality.

With the ink drop weight variation large, it is possible to use various embodiments as a standard for not forming those dots. For example, it is possible to measure the ink drop weight over several times, and when the standard deviation exceeds a specified value, the size dot that is subject to this is made not to be formed. Of course, when the measured value range exceeds a specified range, it is also possible to have the size dot that is subject to this not be formed. Also, it is possible to judge by a relative standard of what ratio this standard deviation or this range is in relation to the target value.

Also, as another example of not being able to form suitable dots, there is the case of the dot shape being distorted. For example, there are cases when the ink drops become fragmented when ink is ejectn from the nozzle, and the formed dots also become fragmented. With this embodiment, when the aforementioned small ink drop of K ink has this situation apply, the K ink small dots are made not to be formed. Also, as shown in FIG. 24, large dots are formed by synthesizing the small ink drops and large ink drops, so even when the landing position of both of these do not match, the dots are in a segmented form. Even when the dot shape is distorted, the printing image quality becomes poor, so when distorted dots are formed, dots of that size can be made not to be used.

The printing image quality also becomes worse when the ink drop landing position is inaccurate, so that dot can be made not to be formed. For example, at a specified printing resolution, when the dot center does not go in the space of a size of the landing target (1/printing resolution), it is possible to also have that dot not be used. When distance between the center of gravity of the landing target space and the center of the formed dot is measured, when this distance exceeds a specified threshold value, it is also possible to have that dot not be used. Of course, it is also possible to acquire that distance standard deviation or range, etc. and make a judgment.

Also, when there is an ink for which there is not much of an effect on image quality even if a specific size of dot is made not to be formed, it is possible to actively not have the specific dots of that ink be formed. For example, even if with a light colored ink, only large dots are used to form images, there is little sense of granularity. Therefore, it is possible to correlate a dot recoding rate conversion table for which small dots are not formed to light colored inks such as Y, lc, and lm ink, for example. In this case, since it is possible to avoid ejecting very fine ink drops, ink mist is not generated easily, and it is possible to make it difficult for the printing device to become dirty. Also, since small dots can be replaced by large and medium dots that have a lower count than these, it is possible to suppress the ink ejecting frequency. Therefore, since it is possible to suppress the frequency of voltage application to the piezo element, it is also possible to suppress the variation of ink ejection amount due to this voltage residual vibration. To achieve the concerned goals, with this embodiment, a dot recording rate conversion table T2 is correlated to the lc, lm, and Y inks by the ink correspondence table T3.

For any ink, the information of which size dot will not be formed is stipulated by the dot recording rate conversion tables T1 and T2 and the ink correspondence table T3. With this embodiment, the dot recording rate conversion tables T1 and T2 and the ink correspondence table T3 are set in advance at the printer 40 and each in development stage. It is difficult for a user to evaluate ink ejection amount variation, dot shape, and dot landing position precision, etc., and it is desirable for the manufacturer to set these in advance. Of course, this is not limited to times for which the manufacture set these in advance, and it is also possible to have a structure whereby the user corrects the dot recording rate conversion tables T1 and T2 and the ink correspondence table T3 to a suitable item. For example, when a user wishes to obtain high level image quality using small dots even for light colored inks, one can change the settings so that the dot recording rate conversion table T1 is correlated to the Y, lc, and lm inks with the ink correspondence table T3.

As explained above, with the print control apparatus of the second embodiment of the present invention, a dot recording rate conversion table, for which a specific size dot is excluded for a specific ink with expression only by other sized dots, is referenced, and dot recording rate conversion is performed. By doing this, it is possible to perform printing without forming a specific size dot for which it is not possible to perform suitable formation of dots for a specific ink. Specifically, since it is possible to express a printing image with only suitable dots, it is possible to improve the printing image quality.

F: Variation Examples

Note that the present invention is not limited to the embodiments and embodiments noted above, and that it can be implemented in a variety of formats in a scope that does not stray from the key points, with the following variations possible, for example.

F-1. With each of the embodiments described above, a printer is used for which it is possible to selectively form any of three types of dots of different sizes on one pixel area on the printing medium using each nozzle, but, for example, it is also possible to use a printer for which it is possible to selectively form two types of dots, or to use a printer for which it is possible to selectively form four or more types of dots. The printer used for the present invention is acceptable as long as it is able to selectively form any of N types (N is an integer of 2 or greater) of dots of different sizes on one pixel area on the printing medium using each nozzle.

F-2. With each of the embodiments described above, the binarization process that determines whether or not dots are formed using ordered dither or error diffusion was performed, but it is also possible to reduce the gradation value using another gradation-reduction processing method such as the density pattern method, for example. When performing gradation-reduction processing using the density pattern method, since it is possible to form dot patterns with multiple dots on each pixel, it is possible to express each pixel with three or more gradations.

The gradation-reduction processing unit used with the present invention is acceptable as long as it is generally constructed so that the formation status of each size dot is determined for each pixel. Note that pixels for the image data and pixels on the printing medium do not necessarily have to have a one-to-one correspondence, and it is also possible to correlate one pixel for the image data to multiple pixels on the printing medium.

F-3. With each of the embodiments described above, the dot type is selected according to the printing device operating mode (printing mode), but it is also possible to select a dot type according to the printer to which the print control apparatus is connected, for example, and it is also possible to have the dot type selected according to the printer in which a print control apparatus is built in. In this way, "according to the printing environment" in the claims has a broad meaning which includes the kinds of hardware environment and software environment described above.

By working in this way, it is possible to mount a common gradation-reduction module on various types of printing devices. In a case such as when a gradation-reduction module is mounted on, for example, a DSP (Digital Signal Processor) or other hardware, this shows a marked effect of improving system reliability and perform and through used of common hardware.

F-4. With each of the embodiments described above, we explained examples of inkjet printers equipped with a piezo element, but it is also possible to use this on other printing devices such as various types of printers including printers that eject ink with bubbles that occur within the ink by conducting electricity to a heater equipped with a so-called nozzle.

F-5. This invention may also be used for black and white printers rather than just color printers. It may also be used for printers that express many gradations by expressing one pixel using multiple dots.

F-6. In any of the above embodiments, part of the hardware configuration may be replaced by the software configuration, while part of the software configuration may be replaced by the hardware configuration. For example, part or all of the functions of the printer driver 96 shown in FIG. 1 may be executed by the control circuit 40 in the printer 20. In this modified structure, the control circuit 40 of the printer 20 exerts part or all of the functions of the computer 90 as the print control device that generates print data.

When part or all of the functions of the invention are attained by the software configuration, the software (computer programs) may be stored in computer-readable recording media. The 'computer-readable recording media' of the invention include portable recording media like flexible disks and CD-ROMs, as well as internal storage devices of the computer, such as various RAMs and ROMs, and external storage devices fixed to the computer, such as hard disks.

Finally, the following Japanese patent applications which this application uses as a base for claim of priority are also included in the disclosure for reference.

(1) Patent Application 2003-312102 (Application date: Sep. 4, 2003)

(2) Patent Application 2003-409000 (Application date: Dec. 8, 2003)

What is claimed is:

1. A printing control method of generating print data to be supplied to a print unit, wherein the print unit comprises a print head having a plurality of nozzles for ejecting ink, and is capable of selectively forming one of N types of dots each having different sizes at one pixel area with the print head, N being an integer equal to or greater than 2, the printing control method comprising:

a dot data generation step of generating dot data based on an image data, the dot data representing a state of dot formation at each pixel, wherein the dot data generation step has a first printing mode in which the dot data for an ink type is generated as dot data using the N types of dots, and a second printing mode in which the dot data for the ink type is generated as dot data using a part of the N types of dots other than at least one of the N types of dots, wherein ink volumes for the used part of the N types of dots is respectively substantially same as ink volumes for corresponding types of dots used in the dot data for the ink type to be generated in the first printing mode.

2. A printing control method of generating print data to be supplied to a print unit, wherein the print unit comprises a print head having a plurality of nozzles for ejecting a plurality types of ink, is capable of selectively forming one of N1 types of dots of a first ink type each having different sizes at one pixel area with the print head, and is capable of selectively forming one of N2 types of dots of a second ink type at one pixel area with the print head, N1 being an integer equal to or greater than 2, N2 being an integer equal to or greater than 1, the printing control method comprising:

a dot data generation step of generating dot data for the plurality types of ink based on an image data, the dot data representing a state of dot formation at each pixel, wherein the dot data generation step has a first printing mode in which the dot data for the first ink type is generated as dot data using N1 types of dots, and the dot data for the second ink type is generated as dot data using N2 types of dots and a second printing mode in which the dot data for the first ink type is generated as dot data using N3 types of dots from among the N1 types of dots, and the dot data for the second ink type is generated as dot data using the N2 types of dots, N3 being an integer less than N1.

3. A printing control method of generating print data to be supplied to a print unit, wherein the print unit comprises a print head having a plurality of nozzles for ejecting a plurality types of ink, the printing control method comprising:

a dot data generation step of generating dot data for the plurality types of ink based on an image data, the dot data representing a state of dot formation at each pixel, wherein the dot data generation step has a first printing mode in which the dot data for a first ink type is generated as dot data in which N1 types of dots from among N types of dots each having different sizes are to be selectively formed at one pixel area, and the dot data for a second ink type is generated as dot data in which the N1 types of dots are to be selectively formed at one pixel area, N being an integer equal to or greater than 2, and N1 being integer less than N, and a second printing mode in which the dot data for the first ink type is generated as dot data in which the N types of dots are to be selectively formed at one pixel area.

* * * * *